US012473916B2

(12) United States Patent
Moon et al.

(10) Patent No.: US 12,473,916 B2
(45) Date of Patent: Nov. 18, 2025

(54) SCROLL COMPRESSOR

(71) Applicant: LG Electronics Inc., Seoul (KR)

(72) Inventors: Jehyeon Moon, Seoul (KR); Kyungho Lee, Seoul (KR); Minho Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 198 days.

(21) Appl. No.: 18/337,912

(22) Filed: Jun. 20, 2023

(65) Prior Publication Data

US 2023/0407866 A1 Dec. 21, 2023

(30) Foreign Application Priority Data

Jun. 21, 2022 (KR) ..... 10-2022-0075699

(51) Int. Cl.
*F04C 18/02* (2006.01)

(52) U.S. Cl.
CPC ..... *F04C 18/0215* (2013.01); *F04C 2240/30* (2013.01); *F04C 2240/40* (2013.01); *F04C 2240/60* (2013.01); *F04C 2270/185* (2013.01)

(58) Field of Classification Search
CPC ..... F04C 18/0215; F04C 2240/30; F04C 2240/40; F04C 2240/60; F04C 2270/185; F04C 27/005; F04C 18/0261; F04C 29/0021; F04C 23/02; F04C 29/0085; F04C 29/12; F04C 2240/10; F04C 2240/20;

(Continued)

(56) References Cited

U.S. PATENT DOCUMENTS 6,554,592 B1 4/2003 Sun et al.
7,758,326 B2 * 7/2010 Fujimura ..... F04C 27/005 418/55.1

(Continued)

FOREIGN PATENT DOCUMENTS

EP 2243958 10/2010
EP 3546754 10/2019

(Continued)

OTHER PUBLICATIONS

Extended European Search Report in European Appln. No. 23178683.1, mailed on Oct. 30, 2023, 13 pages.

(Continued)

*Primary Examiner* — Jesse S Bogue
(74) *Attorney, Agent, or Firm* — Fish & Richardson P.C.

(57) ABSTRACT

A scroll compressor includes an orbiting scroll that is coupled to a rotating shaft in a casing and includes an orbiting end plate portion coupled to the rotating shaft and an orbiting wrap that has a spiral shape protruding from one surface of the orbiting end plate portion, a fixed scroll including a fixed wrap that is engaged with the orbiting wrap defines a compression chamber with the orbiting wrap therebetween, and a main frame that rotatably supports the orbiting scroll and defines a back pressure chamber with the orbiting scroll. The fixed scroll defines a fixed back pressure hole having a first end configured to communicate with the first back pressure chamber and a second end is located between outer and inner circumferences of the orbiting wrap. The orbiting wrap is configured to cover at least a portion of the fixed back pressure hole during the orbital motion.

18 Claims, 27 Drawing Sheets

(58) Field of Classification Search
CPC ..... F05B 2210/14; F05B 2240/10; F05B 2240/20; F05B 2240/60
See application file for complete search history.

(56) References Cited

U.S. PATENT DOCUMENTS

| | | | | |
|---|---|---|---|---|
| 9,243,636 | B2 * | 1/2016 | Kim | F04C 29/028 |
| 9,970,438 | B2 * | 5/2018 | Kim | F01C 17/066 |
| 10,533,551 | B2 * | 1/2020 | Kim | F01C 21/102 |
| 11,242,854 | B2 * | 2/2022 | Kim | F04C 29/0021 |
| 11,480,177 | B2 * | 10/2022 | Liang | F04C 29/0007 |
| 2010/0089093 | A1 * | 4/2010 | Kim | F04C 29/028 418/55.6 |
| 2010/0212352 | A1 * | 8/2010 | Kim | F04C 29/042 62/513 |
| 2012/0230854 | A1 * | 9/2012 | Chikano | F04C 18/0253 418/55.2 |
| 2017/0306951 | A1 * | 10/2017 | Chikano | F04C 23/008 |
| 2024/0301880 | A1 * | 9/2024 | Moon | F04C 18/0292 |

FOREIGN PATENT DOCUMENTS

| | | | |
|---|---|---|---|
| JP | 2014-132158 | 7/2014 | |
| JP | 2019-535959 | 12/2019 | |
| KR | 10-2011-0080180 | 7/2011 | |
| KR | 10-2014-0083896 | 7/2014 | |
| KR | 10-1474460 | 12/2014 | |
| KR | 10-2020-0132421 | 11/2020 | |
| KR | 20200132421 A * | 11/2020 | F04C 18/0215 |
| WO | WO 2010/007786 | 1/2010 | |

OTHER PUBLICATIONS

Office Action in Korean Appln. No. KR10-2022-0075699, mailed on Oct. 24, 2023, 18 pages (with English translation).

* cited by examiner

SCROLL COMPRESSOR

CROSS-REFERENCE TO RELATED APPLICATIONS

Pursuant to 35 U.S.C. § 119(a), this application claims the benefit of the earlier filing date and the right of priority to Korean Patent Application No. 10-2022-0075699, filed on Jun. 21, 2022, the contents of which are incorporated by reference herein in their entirety.

TECHNICAL FIELD

The present disclosure relates to a scroll compressor, and more particularly, to a scroll compressor having a structure in which a back pressure chamber pressure is varied according to operating conditions in the scroll compressor.

BACKGROUND

A scroll compressor may include an orbiting scroll and a non-orbiting scroll that are engaged with each other to define a pair of compression chambers while the orbiting scroll performs an orbiting motion with respect to the non-orbiting scroll.

The compression chamber may include a suction pressure chamber defined at an outer side, an intermediate pressure chamber continuously defined toward a central portion from the suction pressure chamber while gradually decreasing in volume, and a discharge pressure chamber extending to the center of the intermediate pressure chamber. In general, the suction pressure chamber may be defined through a side surface of the non-orbiting scroll, the intermediate pressure chamber may be sealed, and the discharge pressure chamber may pass through an end plate portion of the non-orbiting scroll.

Scroll compressors may be classified into a low-pressure type and a high-pressure type according to a path through which refrigerant is suctioned. The low-pressure type is configured such that refrigerant suction pipe is connected to an inner space of a casing to guide suction refrigerant of low temperature to flow into a suction pressure chamber via the inner space of the casing. The high-pressure type is configured such that the refrigerant suction pipe is connected directly to the suction pressure chamber to guide refrigerant to flow directly into the suction pressure chamber without passing through the inner space of the casing.

In some cases, a scroll compressor in the related art may include a check valve configured to control a pressure in the back pressure chamber.

Alternatively, in some cases, in order to adjust the pressure in the back pressure chamber, a back pressure hole (For example, an elongated hollow hole) is machined, and a pressure drop pin is provided in the back pressure hole to adjust the pressure in the back pressure chamber. In some cases, the method in the related art may not be practical due to high cost due to complicated mechanism and machining.

In some cases, a scroll type compressor may include a movable scroll including an inlet port that is open at a front end surface of a movable vortex wall to communicate with a compression chamber, an outlet port disposed on a movable substrate to communicate with a back pressure chamber, and an air supply passage configured with a communication hole communicating between the inlet port and the outlet port to communicate the compression chamber with the back pressure chamber by elastic deformation of the movable scroll or a displacement in a direction of the revolving shaft.

In some cases, a scroll compressor including a discharge pressure region that includes an oil separation chamber for separating lubricating oil from cooling gas discharged from a compression chamber. The oil separation chamber is connected to at least one of a suction pressure region and a compression pressure region through an oil supply passage having a flow restrictor. The flow restrictor is configured with a gap between an oil supply hole disposed in a fixed scroll and an insertion member inserted into the oil supply hole. The gap has a spiral groove shape disposed on at least one of an inner circumferential surface of the oil supply hole and an outer circumferential surface of the insertion member.

In some cases, when a pressure in the back pressure chamber is insufficient, a gap between the fixed scroll and the orbiting scroll wrap may be opened to increase the pressure in the back pressure chamber while high-pressure gas flows into the back pressure chamber. By that effect, the back pressure hole may be closed again to maintain the pressure in the back pressure chamber. In this manner, even when an operating range of the compressor changes, the pressure in the back pressure chamber may be adaptively adjusted, and discharge refrigerant flowing into the back pressure chamber may be introduced into the back pressure chamber only when needed, helping to increase volumetric efficiency.

However, in some cases, since the back pressure hole may be machined at an upper end of a wrap, there is a limitation in the size of the back pressure hole. Furthermore, in order to machine the back pressure hole, the back pressure hole may be machined to a height of the wrap with a tool having a small diameter, thereby increasing a machining time for the back pressure hole and decreasing the life of the tool during mass production. In addition, when the back pressure hole is machined in the wrap, the thickness between the machined part and the wrap wall is reduced, resulting in a problem in rigidity.

Therefore, an increase in size of the back pressure hole and a decrease in the machining height result in a reduction in machining cost, and are advantageous in terms of reliability of the compressor, and in order to solve this problem, the back pressure hole may be machined in an orbiting scroll end plate or a fixed scroll end plate.

In some cases of machining the back pressure hole in the fixed scroll end plate, when the back pressure ratio is not constant and the operating conditions are not optimized, a back pressure force may become strong to generate a friction, thereby causing deterioration in reliability and efficiency.

In some cases of machining the back pressure hole in an end plate of the orbiting scroll, a thickness of the wrap at a central portion of the fixed scroll is exposed regardless of the angle of the revolving back pressure hole to allow a high pressure or a pressure of the exposed chamber to be introduced to the back pressure chamber, thereby preventing the back pressure chamber from performing its function.

SUMMARY

The present disclosure describes a scroll compressor having a structure in which a pressure in a back pressure chamber is varied according to operating conditions in a high-pressure scroll compressor.

The present disclosure further describes a scroll compressor in which an orbiting scroll actively moves in an axial direction by a relationship of forces between a back pressure chamber and a compression chamber regardless of operating conditions, thereby providing constant performance in most operating regions.

The present disclosure further describes a scroll compressor having a structure in which pressures in a primary back pressure chamber and a secondary back pressure chamber are variable.

The present disclosure further describes a scroll compressor having an active structure capable of adjusting a back pressure according to operating conditions such that the scroll compressor does not operate when the back pressure is excessive and operates when the back pressure is low.

According to one aspect of the subject matter described in this application, a scroll compressor includes a casing, a drive motor disposed inside the casing, a rotating shaft rotatably coupled to the drive motor, an orbiting scroll disposed inside the casing and coupled to the rotating shaft, the orbiting scroll comprising (i) an orbiting end plate portion coupled to the rotating shaft and (ii) an orbiting wrap that protrudes in a spiral shape from a surface of the orbiting end plate portion, a fixed scroll comprising a fixed wrap engaged with the orbiting wrap, wherein the fixed wrap and the orbiting wrap are configured to define a compression chamber therebetween based on the orbiting wrap performing an orbital motion relative to the fixed wrap, and a main frame that rotatably supports the orbiting scroll, the main frame defining a first back pressure chamber with the orbiting scroll. The fixed scroll defines a fixed back pressure hole having (i) a first end configured to fluidly communicate with the first back pressure chamber and (ii) a second end located between outer and inner circumferences of the orbiting wrap. The orbiting wrap is configured to cover at least a portion of the second end of the fixed back pressure hole based on the orbiting wrap performing the orbital motion relative to the fixed wrap.

In this manner, a back pressure hole is provided in an orbiting end plate portion instead of machining an adaptive back pressure hole in the orbiting wrap, and when a pressure is insufficient, a gap between the fixed scroll and the orbiting scroll wrap is opened to increase the pressure in the back pressure chamber while high-pressure gas flows into the back pressure chamber, and by that effect, the back pressure hole is closed again to maintain the pressure in the back pressure chamber.

For example, a thickness of the fixed wrap at one position of the fixed wrap covering the orbiting back pressure hole can be twice or more than an orbital radius of the orbiting scroll.

In order to apply an adaptive back pressure structure, a central portion of the compression unit is designed to be thick such that the back pressure hole is always covered by the wrap, and when a pressure is insufficient, a gap between the fixed scroll and the orbiting scroll wrap is opened to increase the pressure in the back pressure chamber while high-pressure gas flows into the back pressure chamber, and by that effect, the back pressure hole is closed again to maintain the pressure in the back pressure chamber.

In some implementations, the orbiting back pressure hole can be disposed in the orbiting end plate portion to be spaced apart from the orbiting wrap inside an inner circumference formed by an inner end portion of the orbiting wrap.

In this manner, since the orbiting back pressure hole is disposed in the orbiting end plate portion to be spaced apart from the orbiting wrap, it is convenient for application due to reduced design constraints, and machining cost and the number of additional parts is reduced due to the simplification of the back pressure structure.

In some implementations, the orbiting back pressure hole can include a first hole disposed in parallel to the rotating shaft; and a second hole disposed in a lateral direction to communicate between one end of the first hole and the first back pressure chamber.

In some implementations, the orbiting back pressure hole is configured to include first and second holes, and as a result, in a high-pressure scroll compressor, when the orbiting scroll retreats in an axial direction due to a low pressure in the first back pressure chamber during the driving of the compressor, a gap is generated between an upper end of the wrap of the fixed scroll and a bottom portion of the orbiting scroll to increase pressure in the back pressure chamber while high-pressure gas flows into the first back pressure chamber through the first and second holes so as to maintain the sealing of the compression chamber while moving the orbiting scroll in the axial direction, thereby increasing the efficiency of the scroll compressor.

In some implementations, the orbiting back pressure hole can be disposed in a straight line between the one end and the other end in the orbiting end plate portion.

As the orbiting back pressure hole is disposed to extend in a diagonal direction, the flow distance is further reduced compared to a case where the high-pressure gas flows through the first and second holes, thereby allowing the high-pressure gas to be more quickly supplied to the first back pressure chamber.

A refrigerant suction pipe can be coupled to the fixed scroll so as to communicate with the compression chamber.

Due to this, in the high-pressure scroll compressor, it can be possible to allow adaptive back pressure.

The scroll compressor of the present disclosure can be provided with a fixed back pressure hole provided in the fixed end plate portion, one end of which is disposed to communicate with the first back pressure chamber, and the other end of which is disposed in a shape that is bent at least once so as to be always covered by an end portion of the orbiting wrap.

For example, a thickness of an end portion of the orbiting wrap covering the fixed back pressure hole can be twice or more than an orbiting radius at which the orbiting scroll performs an orbital rotation.

Due to this, a thickness of the central portion becomes larger by a structure that always covers the back pressure hole, thereby increasing the reliability of the compression unit, and solving the problem of rigidity of the wrap that occurs while machining the wrap.

In some implementations, the fixed back pressure hole can be disposed at an overlapping portion for a plurality of positions, which are relative positions at which the orbiting wrap performs an orbital rotation.

The plurality of positions can be 0 degrees, 90 degrees, 180 degrees, and 270 degrees, respectively.

As the fixed back pressure hole is disposed at an overlapping portion for a plurality of positions such as 0 degrees, 90 degrees, 180 degree and 270 degrees, the fixed back pressure hole becomes a structure that is always covered by the orbiting wrap, thereby allowing adaptive back pressure due to a difference in force between the compression chamber and the back pressure chamber.

The fixed back pressure hole can include a first hole, one end of which is disposed at an end portion of the orbiting wrap, and disposed in parallel to an extending direction of the rotating shaft; a second hole disposed to communicate with the first hole to intersect therewith in a lateral direction; and a third hole disposed in parallel to the first hole to communicate between the first back pressure chamber and the second hole.

Accordingly, the fixed back pressure hole includes first to third holes, and as gas in the compression chamber flows through the first to third holes to be supplied to the first back pressure chamber, thereby allowing adaptive back pressure.

The fixed scroll can be provided with a guide inlet portion disposed between the fixed back pressure hole and the first back pressure chamber to guide the inflow of gas from the fixed back pressure hole to the first back pressure chamber.

Gas flowing through the fixed back pressure hole is guided by the guide inlet portion at a bottom portion of the fixed scroll to flow into the first back pressure chamber.

The fixed wrap can be provided with a fixed step surface to provide different heights, and the orbiting back pressure hole can be disposed to be always covered by a fixed wrap connected to the fixed step surface.

In this manner, the adaptive back pressure structure of the present disclosure can also be applied to a stepped compression unit.

Furthermore, the orbiting end plate portion can be provided with a boss portion to which a rotating shaft is coupled therethrough, and the orbiting back pressure hole can be provided in the boss portion.

In this manner, the adaptive back pressure structure of the present disclosure can also be applied to an axial through scroll (R-type).

According to another aspect, a scroll compressor includes: a casing; a drive motor provided inside the casing; a rotating shaft rotatably coupled to the drive motor; an orbiting scroll provided with an orbiting end plate portion coupled to the rotating shaft and an orbiting wrap protruding in a spiral shape from one surface of the orbiting end plate portion to perform an orbital motion, and coupled to the rotating shaft inside the casing; a fixed scroll provided with a fixed wrap engaged with the orbiting wrap to form a compression chamber with the orbiting wrap therebetween and a fixed end plate portion having the fixed wrap; and a main frame that forms a first back pressure chamber with the orbiting scroll therebetween to rotatably support the orbiting scroll, wherein an orbiting back pressure hole is disposed in the orbiting end plate portion, the orbiting back pressure hole includes a first hole disposed in parallel to the rotating shaft; and a second hole disposed in a lateral direction to communicate between one end of the first hole and the first back pressure chamber, the first hole is located between outer and inner circumferences at one position of the fixed wrap to be always covered by the fixed wrap, and a fixed back pressure hole provided in the fixed end plate portion, one end of which is disposed to communicate with the first back pressure chamber, and the other end of which is disposed in a shape that is bent at least once so as to be always covered by an end portion of the orbiting wrap is provided.

In this manner, in some implementations, a back pressure hole is provided in an orbiting end plate portion instead of machining an adaptive back pressure hole in the orbiting wrap, and a back pressure hole is also provided in a fixed end plate portion, and when a pressure is insufficient, a gap between the fixed scroll and the orbiting scroll wrap is opened to increase the pressure in the back pressure chamber while high-pressure gas flows into the back pressure chamber, and by that effect, the back pressure hole is closed again to maintain the pressure in the back pressure chamber.

A thickness of the fixed wrap at one position of the fixed wrap covering the first hole can be twice or more than an orbital radius of the orbiting scroll.

In order to apply an adaptive back pressure structure, a central portion of the compression unit is designed to be thick such that the back pressure hole is always covered by the wrap, and when a pressure is insufficient, a gap between the fixed scroll and the orbiting scroll wrap is opened to increase the pressure in the back pressure chamber while high-pressure gas flows into the back pressure chamber, and by that effect, the back pressure hole is closed again to maintain the pressure in the back pressure chamber.

A refrigerant suction pipe can be coupled to the fixed scroll so as to communicate with the compression chamber.

Due to this, in the high-pressure scroll compressor, it can be possible to allow adaptive back pressure.

A thickness of an end portion of the orbiting wrap covering the fixed back pressure hole can be twice or more than an orbiting radius at which the orbiting scroll performs an orbital rotation.

Due to this, a thickness of the central portion becomes larger by a structure that always covers the back pressure hole, thereby increasing the reliability of the compression unit, and solving the problem of rigidity of the wrap that occurs while machining the wrap.

The fixed back pressure hole can be disposed at an overlapping portion for a plurality of positions, which are relative positions at which the orbiting wrap performs an orbital rotation.

For example, the plurality of positions can be 0 degrees, 90 degrees, 180 degrees, and 270 degrees, respectively.

As the fixed back pressure hole is disposed at an overlapping portion for a plurality of positions such as 0 degrees, 90 degrees, 180 degree and 270 degrees, the fixed back pressure hole becomes a structure that is always covered by the orbiting wrap, thereby allowing adaptive back pressure due to a difference in force between the compression chamber and the back pressure chamber.

The fixed back pressure hole can include a first hole, one end of which is disposed at an end portion of the orbiting wrap, and disposed in parallel to an extending direction of the rotating shaft; a second hole disposed to communicate with the first hole to intersect therewith in a lateral direction; and a third hole disposed in parallel to the first hole to communicate between the first back pressure chamber and the second hole.

Accordingly, the fixed back pressure hole includes first to third holes, and as gas in the compression chamber flows through the first to third holes to be supplied to the first back pressure chamber, thereby allowing adaptive back pressure.

The fixed scroll can be provided with a guide inlet portion disposed between the fixed back pressure hole and the first back pressure chamber to guide the inflow of gas from the fixed back pressure hole to the first back pressure chamber.

Gas flowing through the fixed back pressure hole is guided by the guide inlet portion at a bottom portion of the fixed scroll to flow into the first back pressure chamber.

In addition, in order to solve still another problem as described above, the scroll compressor of the present disclosure includes a casing; a drive motor provided inside the casing; a rotating shaft rotatably coupled to the drive motor; an orbiting scroll having an orbiting end plate portion, an orbiting wrap protruding in a spiral shape from one surface of the orbiting end plate portion, and a rotating shaft coupling portion protruding from the other surface of the orbiting end plate portion to be coupled to an end portion of the rotating shaft; a non-orbiting scroll having a non-orbiting wrap engaged with the orbiting wrap to form a compression chamber with the orbiting wrap therebetween; and a main frame having a second back pressure chamber at a predetermined distance from the center of the orbiting end plate portion to rotatably support the orbiting scroll, wherein the orbiting end plate portion is provided with one end of an orbiting back pressure hole capable of communicating with the second back pressure chamber, and the other end of the orbiting back pressure hole is located between outer and inner circumferences at one position of the non-orbiting wrap to be always covered by the non-orbiting wrap.

In this manner, in some implementations, a back pressure hole is provided in an orbiting end plate portion instead of machining an adaptive back pressure hole in the orbiting wrap, and a back pressure hole is disposed to be always covered by the non-orbiting wrap, and when a pressure is insufficient, a gap is opened between the fixed scroll and the orbiting scroll wrap to increase the pressure in the back pressure chamber while high-pressure gas flows into the back pressure chamber, and by that effect, the back pressure hole is closed again to maintain the pressure in the back pressure chamber.

The orbiting back pressure hole can be disposed in parallel to the rotating shaft, and disposed to pass through the rotating shaft coupling portion up to a lower end thereof.

As a result, as the orbiting back pressure hole is disposed to pass through the rotating shaft coupling portion up to a lower end thereof, refrigerant gas is supplied to the second back pressure chamber along the orbiting back pressure hole having a downward linear structure to maintain the second back pressure chamber at an intermediate pressure, thereby allowing adaptive back pressure in a low-pressure scroll compressor.

The orbiting back pressure hole can include a first passage disposed in an axial direction by a predetermined distance from the rotating shaft coupling portion; and a second passage disposed in a direction intersecting with the first passage to communicate between the first passage and the second back pressure chamber.

Accordingly, since the orbiting back pressure hole is configured with the first passage and the second passage, refrigerant gas can be supplied to the second back pressure chamber along an L-shaped orbiting back pressure hole to maintain the second back pressure chamber at an intermediate pressure, thereby allowing adaptive back pressure in a low-pressure scroll compressor.

A thickness of the non-orbiting wrap at a position of the non-orbiting scroll covering the orbiting back pressure hole can be twice or more than an orbital radius of the orbiting scroll.

Due to this, a thickness of the central portion becomes larger by a structure that always covers the back pressure hole, thereby increasing the reliability of the compression unit, and solving the problem of rigidity of the wrap that occurs while machining the wrap.

A refrigerant suction pipe can be coupled to the casing at a height spaced apart from the non-orbiting scroll, and refrigerant introduced through the refrigerant suction pipe can flow into the compression chamber through an inside of the casing.

Accordingly, refrigerant gas can be provided to the second back pressure chamber to maintain the second back pressure chamber at an intermediate pressure, thereby allowing adaptive back pressure in a low-pressure scroll compressor.

In some implementations, the scroll compressor can include the casing; a drive motor provided inside the casing; a rotating shaft rotatably coupled to the drive motor; an orbiting scroll provided with an orbiting end plate portion coupled to the rotating shaft and an orbiting wrap protruding in a spiral shape from one surface of the orbiting end plate portion to perform an orbital motion and coupled to the rotating shaft inside the casing; a fixed scroll having a fixed end plate portion and a fixed wrap protruding from the fixed end plate portion to form a compression chamber with the orbiting wrap therebetween so as to engage with the orbiting wrap; and a main frame that forms a first back pressure chamber between the orbiting scroll and the main frame to rotatably support the orbiting scroll, wherein the fixed end plate portion is provided with one end of a fixed back pressure hole capable of communicating with the first back pressure chamber, and the other end of the fixed back pressure hole is located between outer and inner circumferences at one position of the orbiting wrap to be always covered by the orbiting wrap.

Due to this, a thickness of the central portion becomes larger by a structure that always covers the back pressure hole, thereby increasing the reliability of the compression unit, and solving the problem of rigidity of the wrap that occurs while machining the wrap.

A thickness of an end portion of the orbiting wrap covering the fixed back pressure hole can be twice or more than an orbiting radius at which the orbiting scroll performs an orbital rotation.

The fixed back pressure hole can be disposed at an overlapping portion for a plurality of positions, which are relative positions at which the orbiting wrap performs an orbital rotation.

The plurality of positions can be 0 degrees, 90 degrees, 180 degrees, and 270 degrees, respectively.

As the fixed back pressure hole is disposed at an overlapping portion for a plurality of positions such as 0 degrees, 90 degrees, 180 degree and 270 degrees, the fixed back pressure hole becomes a structure that is always covered by the orbiting wrap, thereby allowing adaptive back pressure due to a difference in force between the compression chamber and the back pressure chamber.

The fixed back pressure hole can include a first hole having one end thereof disposed at an end portion of the orbiting wrap, which is disposed in parallel to an extension direction of the rotating shaft; a second hole disposed to communicate with the first hole to intersect therewith in a lateral direction; and a third hole disposed in parallel to the first hole to communicate between the first back pressure chamber and the second hole.

Accordingly, the fixed back pressure hole includes first to third holes, and as gas in the compression chamber flows through the first to third holes to be supplied to the first back pressure chamber, thereby allowing adaptive back pressure.

The fixed scroll can include a guide inlet portion disposed between the fixed back pressure hole and the first back pressure chamber to guide the inflow of gas from the fixed back pressure hole to the first back pressure chamber.

Gas flowing through the fixed back pressure hole is guided by the guide inlet portion at a bottom portion of the fixed scroll to flow into the first back pressure chamber.

DETAILED DESCRIPTION

Figure 1:
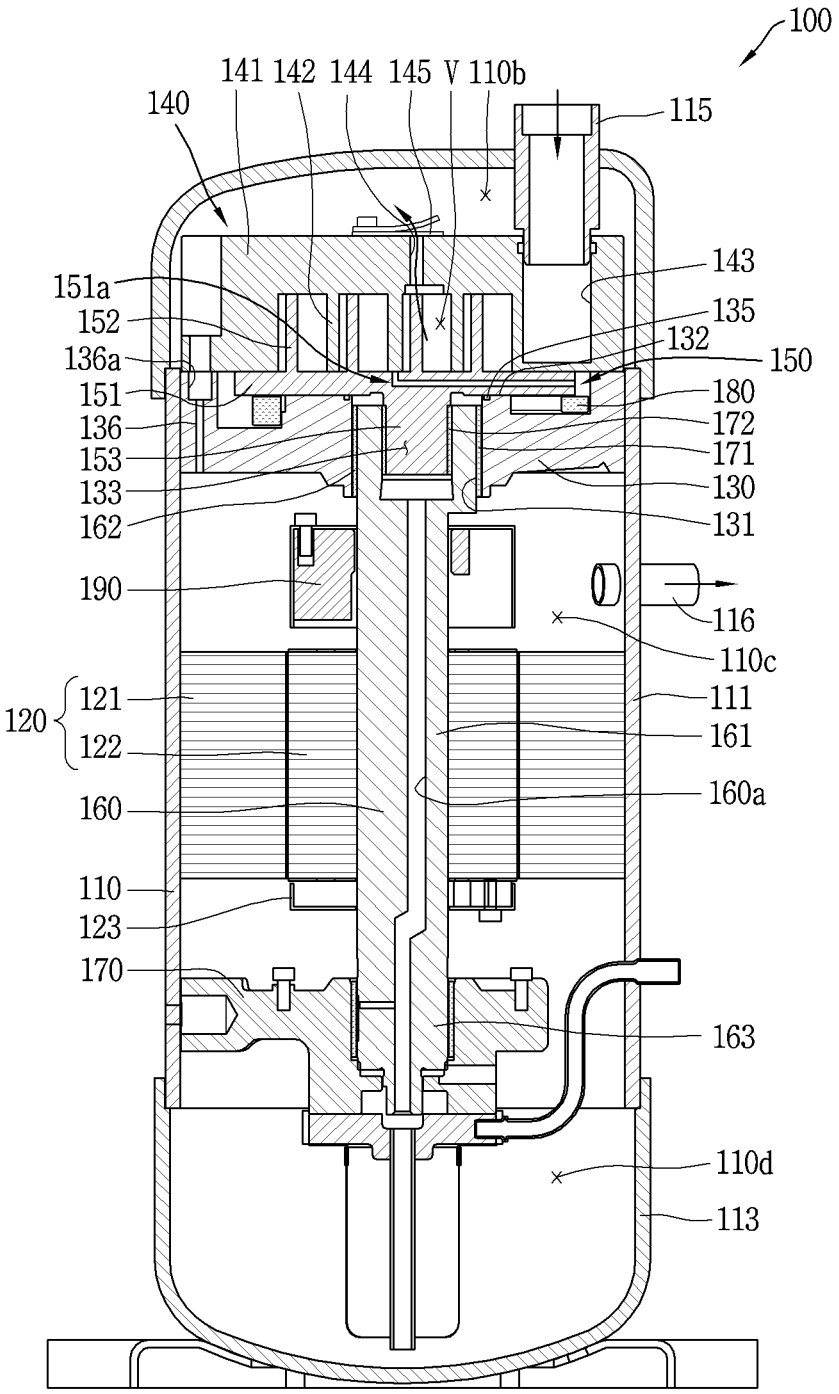
FIG. 1 is a cross-sectional view showing an example of a high-pressure scroll compressor of the present disclosure.

Hereinafter, one or more examples of a scroll compressor will be described with reference to the accompanying drawings. In the present specification, the same or similar reference numerals are assigned to the same or similar components in different implementations, and a redundant description thereof will be omitted.

Figure 2A:
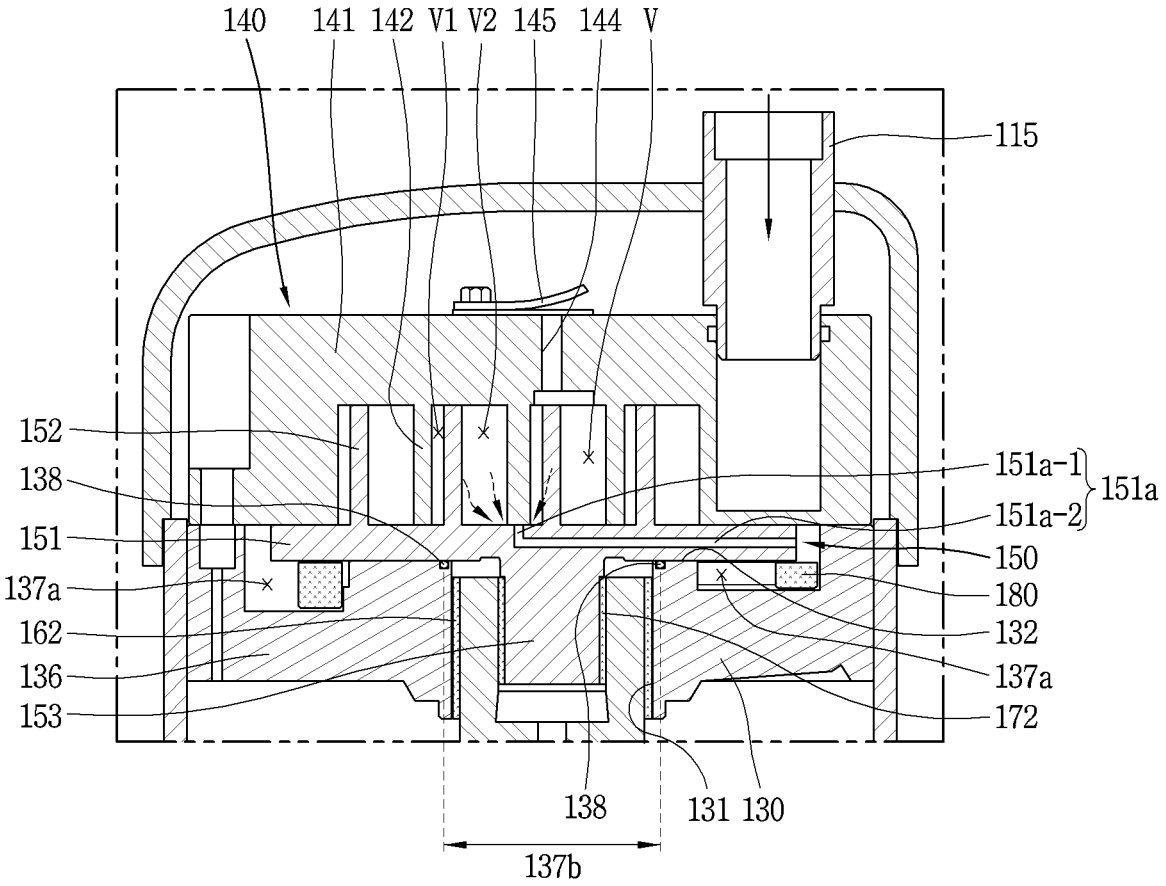
FIG. 2A is an enlarged cross-sectional view showing an example of a back pressure hole defined in an orbiting end plate portion of the scroll compressor.
Figure 2B:
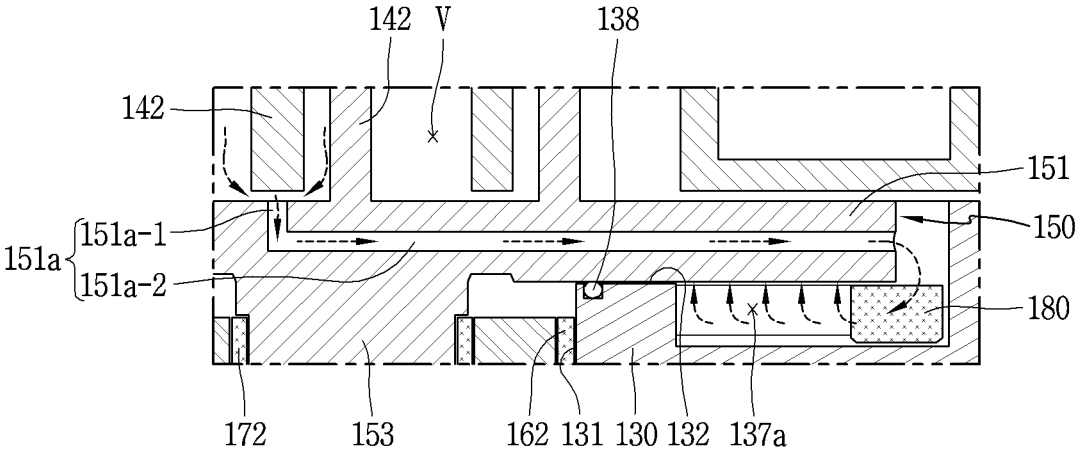
FIG. 2B is a cross-sectional view showing an example in which refrigerant is supplied to a first back pressure chamber through an orbiting back pressure hole through a gap between a fixed wrap and an orbiting end plate portion.

FIG. 1 is a cross-sectional view showing an example of a high-pressure scroll compressor 100 of the present disclosure, and FIG. 2A is an enlarged cross-sectional view showing an example in which an orbiting back pressure hole 151*a* is disposed in an orbiting end plate portion 151 of the scroll compressor 100 of the present disclosure. FIG. 2B is a cross-sectional view showing an example in which refrigerant is supplied to a first back pressure chamber 137*a* through the orbiting back pressure hole 151*a* through a gap between a fixed wrap 142 and the orbiting end plate portion 151.

In some implementations, the scroll compressor 100 can include a casing 110, a drive motor 120, a rotating shaft 160, an orbiting scroll 150, a fixed scroll 140, and a main frame 130.

The drive motor 120 is provided inside the casing 110.

The rotating shaft 160 is configured to be rotatable by the drive motor 120.

The orbiting scroll 150 includes an orbiting end plate portion 151 and an orbiting wrap 152. Furthermore, the orbiting scroll 150 is coupled to the rotating shaft 160 inside the casing 110 to allow orbital rotation.

The orbiting end plate portion 151 is defined in a disk shape coupled to the rotating shaft 160.

The orbiting wrap 152 is disposed to spirally protrude from one side surface of the orbiting end plate portion 151.

The fixed scroll 140 includes a fixed wrap 142. The fixed wrap 142 protrudes from a fixed end plate portion 141 and is engaged with the orbiting wrap 152 to form a compression chamber.

In some examples, the fixed scroll 140 can further include the fixed end plate portion 141. The fixed wrap 142 can be disposed to protrude from the fixed end plate portion 141, and the fixed end plate portion 141 can be defined in a disk shape.

The main frame 130 supports the orbiting scroll 150 to be rotatably at an opposite side of the fixed scroll 140 with the orbiting scroll 150 interposed therebetween. In addition, the main frame 130 forms the first back pressure chamber 137*a* with the orbiting scroll 150 therebetween.

In the scroll compressor 100 of the present disclosure, the orbiting back pressure hole 151*a* is disposed in the orbiting end plate portion 151, and the orbiting back pressure hole 151*a* is disposed to be always covered by the fixed wrap 142.

That is, when the orbiting scroll 150 rotates in an orbital path, the orbiting back pressure hole 151*a* is located between outer and inner circumferences at an end portion of the fixed wrap 142.

As a result, referring to FIG. 2B, in the scroll compressor 100 of the present disclosure, when the orbiting scroll 150 is pushed in an axial direction due to a low back pressure in the first back pressure chamber 137*a*, a gap is generated between the fixed scroll 140 and the orbiting scroll 150 to increase pressure while high-pressure gas flows into the first back pressure chamber 137*a* through the orbiting back pressure hole 151*a* as described above so as to reduce an axial gap while pushing the orbiting scroll 150 in an axial direction, thereby preventing the efficiency of the compressor from being deteriorated.

If the orbiting back pressure hole 151*a* disposed in the orbiting end plate portion 151 is not disposed to be always covered by the fixed wrap 142, then the orbiting back pressure hole 151*a* is exposed to the compression chamber and introduced into the back pressure chamber in the compression chamber to allow the pressure in the back pressure chamber to be the same as the discharge pressure, and as a result, it can be difficult to maintain a gap between the orbiting scroll 150 and the fixed scroll 140, thereby preventing the function of the first back pressure chamber 137*a* from being properly performed.

Therefore, the orbiting back pressure hole 151*a* disposed in the orbital end plate portion 151 needs to be always covered by the fixed wrap 142.

In addition, even when back pressure ratio is not fixed and operating conditions are changed, back pressure can be adjusted according to the operating conditions, thereby increasing the efficiency of the compressor.

In this manner, the scroll compressor 100 of the present disclosure allows "adaptive back pressure".

In the back pressure hole in the related art, there is a restriction to reduce a size of the back pressure hole since the back pressure hole had to be machined at an upper end of the wrap. For this purpose, the back pressure hole may be machined to a height of the wrap with a tool having a small diameter, thereby causing a problem of increasing a machining time for the back pressure hole and decreasing the life of the tool during mass production. Moreover, when the back pressure hole is machined in the wrap, a thickness between the machined portion and the wrap wall is reduced, thereby causing a problem in rigidity.

In the present disclosure, the orbiting back pressure hole 151*a* can be disposed in the orbiting end plate portion 151 or the fixed end plate portion 141, and configured in a structure that is covered by the fixed wrap 142 or the orbiting wrap 152, respectively, thereby improving reliability in the compression unit as well as allowing simple machining.

In some examples, the scroll compressor 100 of the present disclosure can include an implementation applied to the high-pressure scroll compressor 100 and an implementation applied to a low-pressure scroll compressor 200.

Figure 3:
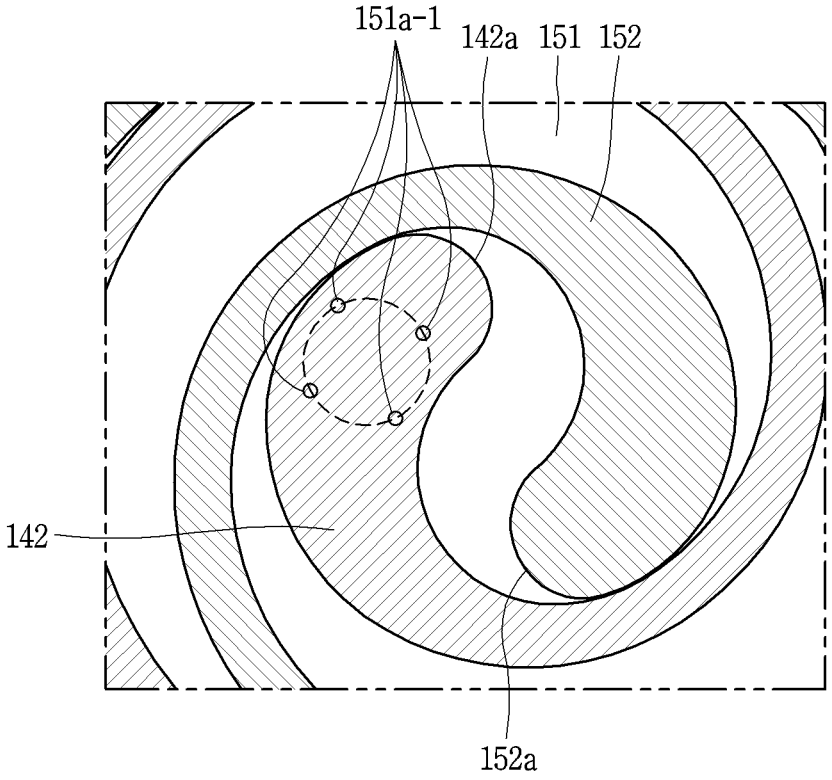
FIG. 3 is an enlarged cross-sectional view showing an example in which the back pressure hole of FIG. 2 is disposed to be covered by a fixed wrap of a fixed scroll when the orbiting scroll rotates in an orbital path.

FIG. 3 is an enlarged cross-sectional view showing an example in which the back pressure hole 151*a* of FIG. 2A is disposed to be covered by the fixed wrap 142 of the fixed scroll 140 when the orbiting scroll 150 rotates in an orbital path.

The orbiting back pressure hole 151*a* can be disposed at an inner side of the orbiting end plate portion 151 so as to be covered by an inner end portion of the fixed wrap 142, and a thickness of the end portion of the fixed wrap 142 covering the orbiting back pressure hole 151*a* can be twice or more than an orbiting radius at which the orbiting scroll 150 performs an orbital rotation.

Referring to FIG. 3, the orbiting diameter of the orbiting scroll 150 at positions of 0 degrees, 90 degrees, 180 degrees, and 270 degrees is 10.4 mm. In the fixed scroll 140, it is shown an example in which a width of the fixed wrap 142 is approximately 13.1 mm, and a width of the orbiting wrap 152 of the orbiting scroll 150 is approximately 13.1 mm similar to the width of the fixed wrap 142 of the fixed scroll 140.

Therefore, the orbiting radius of the orbiting scroll 150 is 5.2 mm, which is a half of the orbiting diameter (10.4 mm) of the orbiting scroll 150.

In this manner, referring to FIG. 3, the width of the fixed wrap 142 of the fixed scroll 140 is disposed to be twice the orbiting radius of the orbiting scroll 150, and thus the orbiting back pressure hole 151*a* can be placed at a position that is always covered by the fixed wrap 142.

Furthermore, with this structure, the orbiting back pressure hole 151*a* is located between outer and inner circumferences at one position of the fixed wrap 142.

In FIG. 3, one position of the fixed wrap 142 can be a position spaced apart by a predetermined distance from a discharge end 142*a* at a center side thereof.

Referring to FIG. 3, the orbiting back pressure hole 151*a* can be disposed in the orbiting end plate portion 151 to be spaced apart from the orbiting wrap 152 inside an inner circumference formed by an inner end portion of the orbiting wrap 152. Furthermore, in FIG. 3, though shown to overlap the fixed wrap 142, but it will be apparent to those skilled in the art that the orbiting back pressure hole 151*a* is disposed in the orbiting end plate portion 151 so as to be blocked by the fixed wrap 142, and disposed in the fixed wrap 142.

As mentioned above, the orbiting back pressure hole 151*a* can always be disposed at a position covered by the fixed wrap 142 of the fixed scroll, and for this purpose, the orbiting back pressure hole 151*a* is disposed inside an inner circumference of an inner end portion of the orbiting wrap of FIG. 3, and can be disposed to be spaced apart from the orbiting wrap 152 in the orbiting end plate portion 151.

In addition, although four orbiting back pressure holes 151*a* are disposed in FIG. 3, these four orbiting back pressure holes 151*a* show moving traces at four places where one orbiting scroll 150 performs an orbital rotation, but may not be limited to cases where the number of orbiting back pressure holes 151*a* is four.

In some examples, the orbiting back pressure hole 151*a* may not be limited to one hole, but can be one of a plurality of holes in some implementations.

In the scroll compressor 100, first and second back pressure chambers 137*a*, 137*b* are disposed between the main frame 130 and the orbiting and fixed scrolls 150, 140.

Referring to FIG. 2A, it is shown an example in which first back pressure chambers 137*a* are disposed on both left and right sides, and second back pressure chambers 137*b* are disposed at a bottom portion of the orbiting end plate portion 151 between the first back pressure chambers 137*a*.

The first back pressure chamber 137*a* is a space in which gas discharged from the compression chamber V is accommodated.

In addition, as mentioned above, in the present disclosure, the orbiting back pressure hole 151*a* is disposed in the orbiting end plate portion 151, and the orbiting back pressure hole 151*a* is disposed at a position that is always covered by the fixed wrap 142 of the fixed scroll 140.

In the first back pressure chamber 137*a*, when the orbiting scroll 150 is pushed in an axial direction due to a low back pressure in the first back pressure chamber 137*a*, a gap is generated between the fixed scroll 140 and the orbiting scroll 150 to increase pressure while high-pressure gas flows into the first back pressure chamber 137*a* through the orbiting back pressure hole 151*a*, and to push the orbiting scroll 150 in an axial direction so as to reduce a gap between the fixed scroll 140 and the orbiting scroll 150, thereby increasing the efficiency of the compressor.

Furthermore, with this structure, even when back pressure ratio is not fixed and operating conditions are changed, back pressure is adjusted according to the operating conditions, thereby increasing the efficiency of the compressor.

For example, the first back pressure chamber 137*a* can be provided between an upper surface of the main frame 130, a side portion of the orbiting scroll 150 and a lower surface of the fixed scroll 140.

FIG. 2A shows an example in which the first back pressure chamber 137*a* is provided between left and right upper surfaces of the main frame 130, both left and right side portions of the orbiting scroll 150, and both bottom surfaces of the fixed scroll 140.

Although the first back pressure chamber 137*a* is shown to be provided on both left and right sides in FIG. 2A, it will be understood as a single space formed between the main frame 130, the orbiting scroll 150, and the fixed scroll 140 along a circumferential direction.

The second back pressure chamber 137*b* is formed near the center of the main frame 130 at a lower portion of the orbiting end plate portion 151 to have a width having a predetermined distance from the center of the orbiting end plate portion 151.

For example, as shown in FIG. 2A, the second back pressure chamber 137*b* can be defined as an inner space of a sealing portion 138 disposed to seal between the main frame 130 and the orbiting scroll 150.

In the case of the high-pressure scroll compressor 100 shown in FIGS. 1 and 2A, the second back pressure chamber 137*b* becomes a discharge pressure to always maintain the highest pressure. When the orbiting scroll 150 is pushed by high pressure in the second back pressure chamber 137*b*, abrasion between the orbiting scroll 150 and the fixed scroll 140 increases, thereby causing a problem in durability.

Therefore, a space of the second back pressure chamber 137*b* is minimized.

Since pressure in the second back pressure chamber 137*b* is too high, the first back pressure chamber 137*a* maintains an intermediate pressure to support the second back pressure chamber 137*b*.

To this end, the orbiting back pressure hole 151*a* is disposed to allow communication between the first back pressure chamber 137*a* and the compression chamber, and a detailed configuration of the orbiting back pressure hole 151*a* will be described later.

In some examples, in the case of the low-pressure scroll compressor 100 to be described later, the first back pressure chamber 137*a* maintains suction pressure (base) and already maintains a low pressure, and thus in some cases, the scroll compressor 200 may not include the structure of the orbiting back pressure hole 151*a* as in the high-pressure scroll compressor 100.

Since the first back pressure chamber 137*a* needs to maintain a low pressure, in the case of the low-pressure scroll compressor 100, it already maintains a low pressure.

In some examples, in the case of the low-pressure scroll compressor 100, the second back pressure chamber 137*b* can communicate with the compression chamber so as to maintain an intermediate back pressure rather than discharge pressure.

Therefore, in the case of the low-pressure scroll compressor 200 (FIG. 11), unlike the orbiting back pressure hole 151*a* of the high-pressure scroll compressor 100, it has a structure in which the orbiting back pressure hole 251*a* allows communication between the second back pressure chamber 237*b* and the compression chamber V.

As a result, the second back pressure chamber 137*b* can be maintained at an intermediate pressure other than discharge pressure.

As will be described later, in the scroll compressor 100 of the present disclosure, the orbiting scroll 150 can actively move in an axial direction by a relationship of forces between a back pressure chamber and a compression chamber regardless of operating conditions, thereby having an effect of providing constant performance in most operating regions.

The structure of the orbiting back pressure hole 151*a* will be described later, and first, the casing 110 and the drive motor 120 will be described in connection with the present disclosure.

The casing 110 is configured to have a sealed inner space. The casing 110 can have, For example, a cylindrical shape.

The casing 110 includes a cylindrical shell 111, an upper cap 112, and a lower cap 113. Accordingly, an inner space 110*a* of the casing 110 can be divided into an upper space 110*b* defined inside the upper cap 112, an intermediate space 110*c* defined inside the cylindrical shell 111, and a lower space 110*d* defined inside the lower cap 113, based on an order that refrigerant flows. Hereinafter, the upper space 110*b* can be defined as a discharge space, the intermediate space 110*c* can be defined as an oil separation space, and the lower space 110*d* can be defined as an oil storage space, respectively.

The cylindrical shell 111 has a cylindrical shape with upper and lower ends open, and the drive motor 120 and the main frame 130 are press-fitted to an inner circumferential surface of the cylindrical shell 111 in a lower half portion and an upper half portion, respectively.

A refrigerant discharge pipe 116 is inserted through the intermediate space 110*c* of the cylindrical shell 111, in detail, coupled through a gap between the drive motor 120 and the main frame 130. The refrigerant discharge pipe 116 can be directly inserted into the cylindrical shell 111 to be welded thereon. Alternatively, an intermediate connecting pipe (i.e., collar pipe) typically made of the same material as the cylindrical shell 111 can be inserted into the cylindrical shell 111 to be welded thereon, and then the refrigerant discharge pipe 116 made of copper can be inserted into the intermediate connection pipe to be welded thereon.

The upper cap 112 is coupled to cover the upper opening of the cylindrical shell 111. A refrigerant suction pipe 115 is coupled to the upper cap 112 therethrough, and the refrigerant suction pipe 115 is directly connected to a suction chamber (no reference numeral) of the compression unit, which will be described later, through the upper space 110*b* of the casing 110. Accordingly, refrigerant can be supplied into a suction chamber through the refrigerant suction pipe 115.

The lower cap 113 is coupled to cover the lower opening of the cylindrical shell 111. The lower space 110*d* of the lower cap 113 defines an oil storage space in which a preset amount of oil is stored. The lower space 110*d* defining the oil storage space communicates with the upper space 110*b* and the intermediate space 110*c* of the casing 110 through an oil return passage (no reference numeral given). Accordingly, oil separated from refrigerant in the upper space 110*b* and the intermediate space 110*c* and oil returned after being supplied to the compression unit can all be returned into the lower space 110*d* defining the oil storage space through an oil return passage to be stored therein.

A drive motor 120 including a stator 121 and a rotor 122 can be disposed in the casing 110. The stator 121 is shrink-fixed to an inner circumferential surface of the casing 110, and the rotor 122 is rotatably provided inside the stator 121.

Hereinafter, the drive motor 120 constituting the motor part will be described with reference to FIG. 1. The drive motor 120 according to this implementation includes a stator 121 and a rotor 122. The stator 121 is fixedly fitted onto the inner circumferential surface of the cylindrical shell 111, and the rotor 122 is rotatably disposed in the stator 121.

The stator 121 includes a stator core and a stator coil.

The stator core is defined in an annular shape or a hollow cylindrical shape and is shrink-fitted onto the inner circumferential surface of the cylindrical shell 111.

A rotor accommodating portion is defined in a circular shape through a central portion of the stator core such that the rotor 122 can be rotatably inserted therein. A plurality of stator-side return grooves 1211*b* can be recessed or cut out in a D-cut shape at an outer circumferential surface of the stator core along the axial direction and disposed at preset distances along a circumferential direction.

In some examples, a plurality of teeth and slots can be alternately arranged on an inner circumferential surface of the rotor accommodating portion in the circumferential direction, and the stator coil can be wound on each tooth by passing through the slots at both sides of the tooth.

The stator coil is wound around the stator core and electrically connected to an external power source through a terminal that is coupled to the casing 110 therethrough. An insulator as an insulating member is interposed between the stator core and the stator coil.

The insulator can be provided at outer and inner circumferential sides to accommodate a bundle of stator coil in a radial direction to extend in both axial directions of the stator core.

The rotor 122 includes a rotor core and a permanent magnet.

The rotor core is defined in a cylindrical shape, and accommodated in a rotor accommodating portion disposed in a central portion of the stator core.

Specifically, the rotor core is rotatably inserted into the rotor accommodating portion of the stator core with a distance by a preset air gap 120*a*. The permanent magnet is embedded inside the rotor core with a preset distance along a circumferential direction.

A balance weight 123 can be coupled to a lower end of the stator core. Alternatively, the balance weight 123 can be coupled to a main shaft portion 161 of the rotating shaft 160 to be described later. This implementation will be described based on an example in which the balance weight 123 is coupled to the rotating shaft 160. The balance weight 123 can be disposed on each of a lower end side and an upper end side of the rotor, and the two balance weights 123 can be installed symmetrically to each other.

The rotating shaft 160 is coupled to the center of the rotor core. An upper end portion of the rotating shaft 160 is press-fitted to the rotor 122, and a lower end portion of the rotating shaft 160 is rotatably inserted into the main frame 130 to be supported in the radial direction.

The main frame 130 is provided with a main bearing 171 configured as a bush bearing to support the lower end portion of the rotating shaft 160. Accordingly, a portion, which is inserted into the main frame 130, of the lower end portion of the rotating shaft 160 can smoothly rotate inside the main frame 130.

The rotating shaft 160 can transfer a rotational force of the drive motor 120 to the orbiting scroll 150 constituting the compression unit. Accordingly, the orbiting scroll 150 eccentrically coupled to the rotating shaft 160 can perform an orbiting motion with respect to the fixed scroll 140.

Although not clearly shown in the drawing, a coil can be wound around the stator 121, and the coil can be electrically connected to an external power source through a terminal coupled to the casing 110 therethrough. The rotating shaft 160 is eccentrically coupled to the center of the rotor 122.

As shown in FIG. 1, a main bearing 171 supporting the rotating shaft 160 in the radial direction is press-fitted and coupled to an upper portion of the rotating shaft 160, and the first bearing 171 can be coupled between the main frame 130, the orbiting scroll 150 and the rotating shaft 160 to rotate the rotating shaft 160. For example, the first bearing 171 can be configured with a bush bearing.

Furthermore, a lower end portion of the rotating shaft 160 is rotatably inserted into and coupled to the sub frame 170, thereby allowing the rotating shaft 160 to rotate while being supported in a radial direction by the main frame 130 and the sub frame described above. The main bearing 171 and the sub bearing for supporting the rotating shaft 160 are respectively inserted into and coupled to the main frame 130 and the sub frame 170. For example, each of the main bearing 171 and the sub bearing can respectively be bush bearings.

The orbiting scroll 150 according to the present implementation includes an orbiting end plate portion 151, an orbiting wrap 152, and a rotating shaft coupling portion 153.

The orbiting end plate portion 151 is defined in a disk shape and accommodated in the main frame 130. An upper surface of the orbiting end plate portion 151 can be supported in an axial direction by the main frame 130 by interposing a back pressure sealing member (no reference numeral) therebetween.

The orbiting wrap 152 can extend from a lower surface of the orbiting end plate portion 151 toward the fixed scroll 140. The orbiting wrap 152 is engaged with the fixed wrap 142 to define the compression chamber V.

The orbiting wrap 152 can be defined in an involute shape together with the fixed wrap 142. However, the orbiting wrap 152 and the fixed wrap 142 can be defined in various shapes other than the involute shape.

For example, the orbiting wrap 152 can be defined in a substantially elliptical shape in which a plurality of arcs having different diameters and origins are connected and the outermost curve can have a major axis and a minor axis. The fixed wrap 142 can also be defined in a similar manner.

An inner end portion of the orbiting wrap 152 can be disposed at a central portion of the orbiting end plate portion 151, and the rotating shaft coupling portion 153 can be disposed to pass through the central portion of the orbiting end plate portion 151 in an axial direction.

The eccentric portion 162 of the rotating shaft 160 is rotatably inserted into the rotating shaft coupling portion 153. An outer circumferential part of the rotating shaft coupling portion 153 is connected to the orbiting wrap 152 to define the compression chamber V together with the fixed wrap 142 during a compression process.

The rotating shaft coupling portion 153 can be disposed at a height that overlaps the orbiting wrap 152 on the same plane. That is, the rotating shaft coupling portion 153 can be disposed at a height at which the eccentric portion 162 of the rotating shaft 160 overlaps the orbiting wrap 152 on the same plane. Accordingly, repulsive force and compressive force of refrigerant can cancel each other while being applied to the same plane based on the orbiting end plate portion 151, and thus inclination of the orbiting scroll 150 due to interaction between the compressive force and the repulsive force can be suppressed.

The rotating shaft coupling portion 153 can include a coupling side portion that is in contact with an outer circumference of an orbiting bearing 172 to support the orbiting bearing 172.

In addition, the rotating shaft coupling portion 153 can further include a coupling end portion that is in contact with one end of the orbiting bearing 172 to support the orbiting bearing 172.

In some implementations, the compression chamber V is formed in a space defined by the fixed end plate portion 141, the fixed wrap 142, the orbiting end plate portion 151, and the orbiting wrap 152. The compression chamber V can include a first compression chamber V1 defined between an inner surface of the fixed wrap 142 and an outer surface of the orbiting wrap 152, and a second compression chamber V2 defined between an outer surface of the fixed wrap 142 and an inner surface of the orbiting wrap 152.

The fixed scroll 140 is provided with a disk-shaped fixed end plate portion 141, and the fixed end plate portion 141 is coupled to the main frame 130 and supported in an axial direction.

The fixed wrap 142 is disposed on a bottom surface of the fixed end plate portion 141, and a suction port 143 is disposed at an edge of the fixed end plate portion 141 to communicate between the suction pipe 115 and the compression chamber V, a discharge port 144 for discharging refrigerant compressed in the compression chamber V to an inner space of the casing 110 is disposed at the center of the fixed end plate portion 141, and a check valve 145 for opening and closing the discharge port is provided at an end portion of the discharge port 144.

Accordingly, the discharge port 144 is open when the compressor is operating normally, but the check valve 145 closes the discharge port 144 when the compressor stops, thereby preventing refrigerant discharged into an inner space of the casing 110 from flowing back to the compression chamber V through the discharge port 144.

The main frame 130 rotatably supports the orbiting scroll 150 at an opposite side of the fixed scroll 140 with the orbiting scroll 150 therebetween, and is supportably connected to the fixed scroll 140.

The main frame 130 can be configured with a scroll fixing portion 136 that can be fixed to support the fixed scroll 140. Furthermore, the scroll fixing portion 136 can include a fastening hole 136*a* for fixing the fixed scroll 140.

A plurality of scroll fixing portions 136 can be disposed along a circumferential direction of the main frame 130.

In FIG. 1, it is not clearly shown that the scroll fixing portions 136 are provided on both left and right sides of the main frame 130, but For example, four or five scroll fixing portions 136 can be provided along a circumferential direction of the main frame 130.

In addition, the main frame 130 includes an orbiting space portion 133, which is a space formed thereinside to accommodate the rotating shaft coupling portion 153 so as to perform an orbital motion, and a scroll support surface 132 disposed around the orbiting space portion 133 to have a predetermined width on an upper surface of the main frame 130.

The main frame 130 includes a first back pressure chamber 137*a*, which is a space in which gas discharged from the compression chamber V is accommodated.

For example, the first back pressure chamber 137*a* can be provided between an upper surface of the main frame 130, a lower side portion of the orbiting scroll 150 and a lower surface of the fixed scroll 140.

FIG. 2A shows an example in which the first back pressure chamber 137*a* is provided between left and right upper surfaces of the main frame 130, both left and right side portions of the orbiting scroll 150, and both bottom surfaces of the fixed scroll 140.

Although the first back pressure chamber 137*a* is shown to be provided on both left and right sides in FIG. 2A, it will be understood as a single space formed between the main frame 130, the orbiting scroll 150, and the fixed scroll 140 along a circumferential direction.

As shown in FIG. 2B, when the orbiting scroll 150 is pushed in an axial direction (a downward direction in FIGS. 2A and 2B) due to a low back pressure in the first back pressure chamber 137*a*, a gap is generated between the fixed scroll 140 and the orbiting scroll 150 to increase pressure while high-pressure gas flows into the first back pressure chamber 137*a* through the orbiting back pressure hole 151*a* that is machined in the foregoing orbiting end plate portion 151 so as to reduce an axial gap between the orbiting scroll 150 and the fixed scroll 140 while pushing the orbiting scroll 150 in an axial direction, thereby preventing the efficiency of the compressor from being deteriorated.

In some implementations, even when back pressure ratio is not fixed and operating conditions are changed, back pressure is adjusted according to the operating conditions, thereby increasing the efficiency of the compressor.

In some examples, the orbiting space portion 133 can be provided as a cylindrical space, for an example. Furthermore, the scroll support surface 132 can be provided along a circumferential direction around the orbiting space portion 133.

The orbiting scroll 150 is configured to perform an orbital motion. On one surface of the orbiting scroll 150, the rotating shaft coupling portion 153 protruding to be inserted into the rotating shaft 160 that can be rotated by power transmitted from the outside can be disposed.

FIG. 1 shows an example in which the rotating shaft coupling portion 153 is disposed to protrude from a bottom surface of the orbiting end plate portion 151 of the orbiting scroll 150 to be described later.

In some examples, the shape of the rotating shaft coupling portion 153 may not be limited to this structure. For example, the shape can also be configured in a boss-type structure, where, when configured in the boss-type structure, it can be configured in a structure in which an upper portion of the rotating shaft 160 is inserted into the rotating shaft coupling portion 153 having the boss-type structure.

In addition, the orbiting scroll 150 is disposed on an upper surface of the main frame 130. The orbiting scroll 150 performs an orbital motion between the main frame 130 and the fixed scroll 140 to be described later.

As mentioned above, the orbiting scroll 150 according to the present implementation includes a disk-shaped orbiting end plate portion 151 and an orbiting wrap 152 spirally disposed on one side surface of the orbiting end plate portion 151.

Referring to FIGS. 2A, 3 and the like, it is shown an example of the disk-shaped orbiting end plate portion 151 having a predetermined width, and the orbiting wrap 152 in which a spirally shaped cross section extends upward from an upper surface of the orbiting end plate portion 151. The orbiting wrap 152 together with the fixed wrap 142 forms a compression chamber V.

Here, the compression chamber V can include a first compression chamber V1 formed on an outer surface and a second compression chamber V2 formed on an inner surface with respect to the fixed wrap 142, wherein the first compression chamber V1 and the second compression chamber V2 are respectively configured with a suction pressure chamber, an intermediate pressure chamber, and a discharge pressure chamber in succession.

As mentioned above, in the scroll compressor 100 of the present disclosure, it has been described that the orbiting back pressure hole 151*a* is disposed in the orbiting end plate portion 151 or the fixed end plate portion 141, and the orbiting back pressure hole 151*a* is disposed to be always covered by the fixed wrap 142 or the orbiting wrap 152.

More specifically, in the scroll compressor 100 of the present disclosure, the orbiting back pressure hole 151*a* can be disposed in the orbiting end plate portion 151, and in this case, the orbiting back pressure hole 151*a* can be disposed to be always covered by the fixed wrap 142. Alternatively, in the scroll compressor 100 of the present disclosure, the orbiting back pressure hole 151*a* can be disposed in the fixed end plate portion 141, and in this case, the orbiting back pressure hole 151*a* can be disposed to be always covered by the orbiting wrap 152.

Hereinafter, an example in which the orbiting back pressure hole 151*a* is disposed in the orbiting end plate portion 151, and disposed to be always covered by the fixed wrap 142 will be described.

Furthermore, a thickness of an end portion of the fixed wrap 142 covering the orbiting back pressure hole 151*a* can be twice or more than an orbiting radius at which the orbiting scroll 150 performs an orbital rotation.

Referring to FIG. 3, it is shown an example in which the fixed wrap 142 of the fixed scroll 140 and the orbiting wrap 152 of the orbiting scroll 150 are engaged with each other, and the orbiting back pressure hole 151*a* is disposed in the orbiting end plate portion 151 at one position thereof, and the position of the orbiting back pressure hole 151*a* relatively moves with respect to the fixed scroll 140 as the orbiting scroll 150 performs an orbital rotation.

It is shown that the orbital back pressure hole 151*a* forms a circular trace as the orbiting scroll 150 starts an orbital rotation at a position of 0 degrees, and performs an orbital rotation at 90 degrees, 180 degrees, and 270 degrees.

An example in which a diameter at which the orbiting back pressure hole 151*a* rotates according to the orbital rotation of the orbiting scroll 150 is 10.4, and a width near an end of the central portion of the orbiting wrap 152 of the orbiting scroll 150 is 13.1 is shown.

As shown in FIG. 3, a thickness of an end portion of the fixed wrap 142 covering the orbiting back pressure hole 151*a* can be twice or more than and three times or less than a radius at which the orbiting scroll 150 performs an orbital rotation.

As a result of the experiment, when a diameter at which the orbiting back pressure hole 151*a* rotates according to the orbital rotation of the orbiting scroll 150 is 10.4 and a thickness of the end portion of the fixed wrap 142 is 6.82, the orbital back pressure hole is covered by the end portion of the fixed wrap 142 at 0 degrees (closed state), but half-closed by the end portion of the fixed wrap 142 at 90 degrees (half-open state), and not closed by the end portion of the fixed wrap 142 at 180 and 270 degrees (open state).

This is because the thickness of the end portion of the fixed wrap 142 covering the orbiting back pressure hole 151*a* is twice or less than an orbiting radius at which the orbiting scroll 150 performs an orbital rotation. That is, the thickness of the end portion of the fixed wrap 142 covering the orbiting back pressure hole 151*a* can be twice or more than the orbiting radius at which the orbiting scroll 150 performs an orbital rotation, and can be twice or more and three times or less than that.

The orbiting the orbiting back pressure hole 151*a* can be disposed in the orbiting end plate portion 151 to be spaced apart from the orbiting wrap 152 inside an inner circumference formed by an inner end portion of the orbiting wrap 152.

The orbiting back pressure hole 151*a* can be disposed in an "L" shape.

The orbiting back pressure hole 151*a* can include first and second holes 151*a*-1, 151*a*-2.

The first hole 151*a*-1 is disposed in parallel to the rotating shaft 160 inside an inner circumference formed by an inner end portion of the orbiting wrap 152 so as to be spaced apart from the orbiting wrap 152 in the orbiting end plate portion 151.

The second hole can be disposed in a lateral direction between the first hole 151*a*-1 and the orbiting back pressure hole 151*a*.

Referring to FIG. 2A, it is shown an orbiting back pressure hole 151*a* defined in an "L" shape, wherein an example in which the first hole 151*a*-1 of the orbiting back pressure hole 151*a* is disposed in parallel to the rotating shaft 160 is shown. Furthermore, an example in which the second hole is disposed in a lateral direction to communicate between one end of the first hole 151*a*-1 and the back pressure chamber is shown.

As shown in FIG. 2A, the first hole 151*a*-1 is disposed such that an upper end thereof is disposed at a position where the upper end is always covered by the fixed wrap 142 so as to block an upper end of the first hole 151*a*-1 by a lower end of one of the fixed wraps 142 disposed thereinside. In addition, a lower end of the first hole 151*a*-1 is disposed to communicate with the second hole. In other words, the first hole 151*a*-1 and the second hole are connected to form an "L" shape.

That is, referring to FIG. 2A, the second hole is disposed in a lateral direction from a lower end of the first hole 151*a*-1 to provide a structure communicating with the first back pressure chamber 137*a*.

Although not clearly shown in FIG. 2A, referring to FIG. 1, the refrigerant suction pipe 115 is coupled to the fixed scroll 140 to provide a structure capable of directly communicating with the compression chamber so as to constitute the high-pressure scroll compressor 100.

FIG. 2A shows a cross section at a slightly different angle from that of FIG. 1, where the "L"-shaped orbiting back pressure hole 151*a* can be applied to the high-pressure scroll compressor 100 as shown in FIG. 1.

Referring to FIG. 2B, when the orbiting scroll 150 is pushed in an axial direction due to a low back pressure in the first back pressure chamber 137*a*, a gap is generated between the fixed wrap 142 of the fixed scroll 140 and the orbiting end plate portion 151 of the orbiting scroll 150 to increase pressure inside the first back pressure chamber 137*a* while high-pressure gas flows into the first back pressure chamber 137*a* through the first and second holes 151*a*-1, 151*a*-2 of the orbiting back pressure hole 151*a* so as to reduce an axial gap while pushing the orbiting scroll 150 in an axial direction, thereby preventing the efficiency of the compressor from being deteriorated.

Figure 4A:
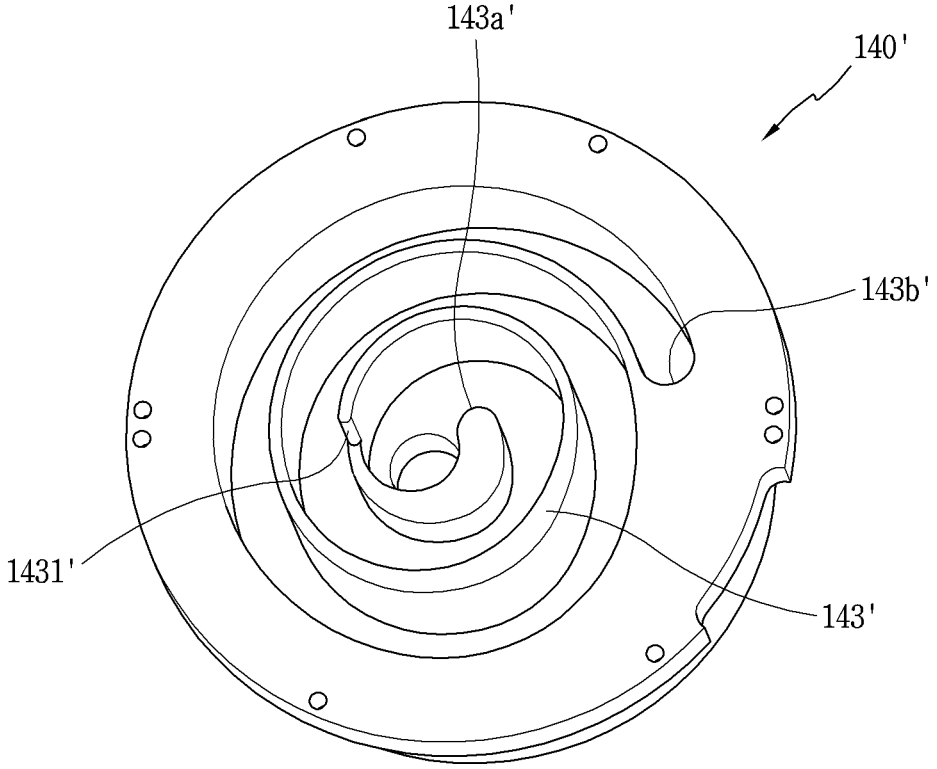
FIG. 4A is a perspective view showing an example of a fixed scroll having a stepped structure viewed from the bottom.
Figure 4B:
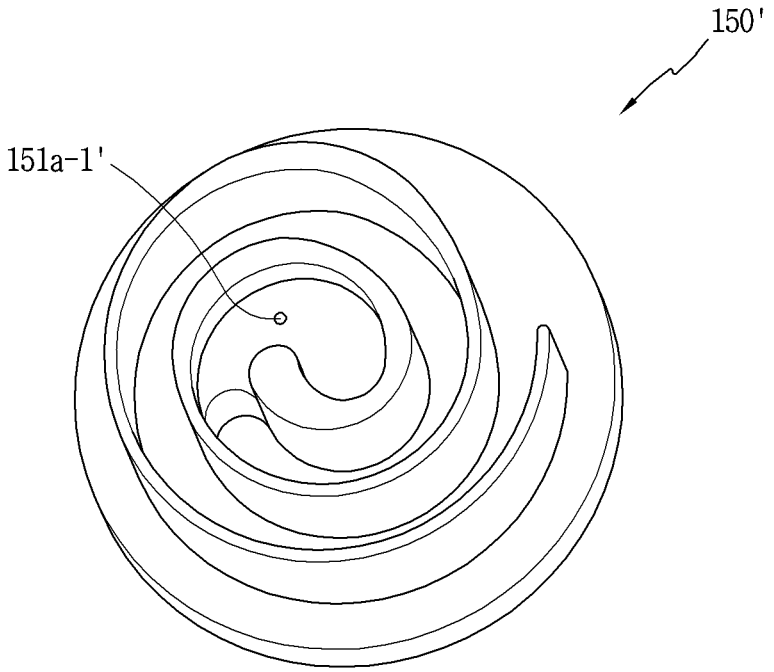
FIG. 4B is a perspective view showing an example of an orbiting scroll coupled to the fixed scroll of FIG. 4A.

FIG. 4A is a perspective view of the fixed scroll 140 having a stepped structure viewed from the bottom, and FIG. 4B is a perspective view showing the orbiting scroll 150 coupled to the fixed scroll 140 of FIG. 4A.

In the present disclosure, the aforementioned orbiting back pressure hole 151*a* can be applied not only to a logarithmic spiral compression unit but also to a stepped scroll shown in FIGS. 4A and 4B.

FIG. 4A shows a stepped fixed scroll, wherein an example in which a wrap height of the fixed wrap 143' is varied along a wrap formation direction of the fixed wrap 143' is shown in FIG. 4A. For example, in the present implementation, a fixed step surface 1431', which will be described later, is disposed in the middle of the fixed wrap 143', and a wrap height of a discharge end 143*a*' at a center side with respect to the fixed step surface 1431' is disposed to be lower than that of a suction end 143*b*' at an outermost side. Accordingly, a wrap strength at the discharge end 143*a*' of the fixed wrap 143' receiving a relatively high gas force can be increased to suppress the fixed wrap 143' from being damaged.

In the case of a stepped scroll, since the scroll wrap is designed using an arc, the design of a central portion thereof is slightly more free compared to that of the logarithmic spiral compression unit. In addition, even in the case of a stepped scroll, it can be applicable both to the scroll compressor 100 having a high-pressure structure described above, and to the scroll compressor 100 having a low-pressure structure to be described later.

The other detailed configuration of the stepped scroll will be omitted.

Figure 5A:
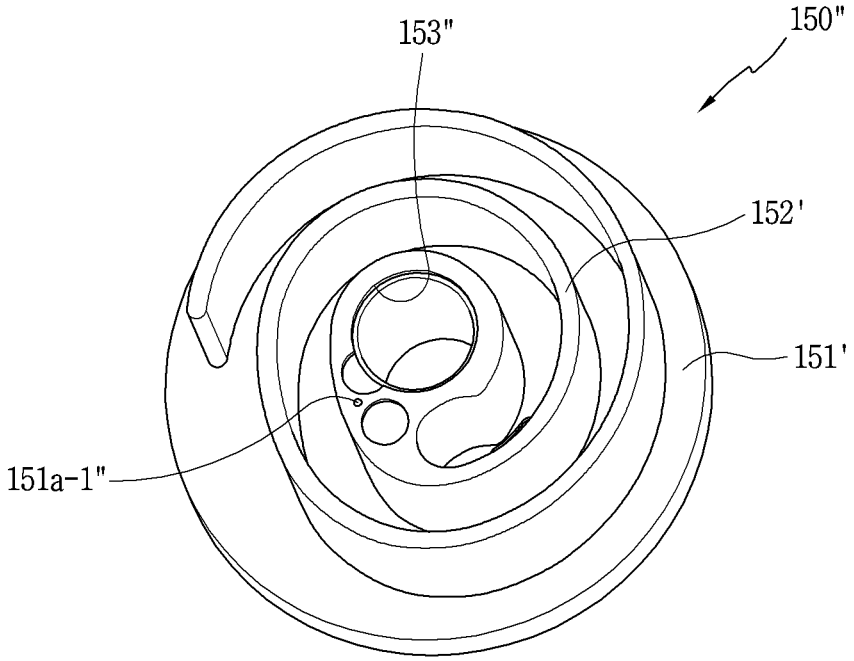
FIG. 5A is a perspective view showing an example of an orbiting scroll having an R-shaped structure viewed from the bottom.
Figure 5B:
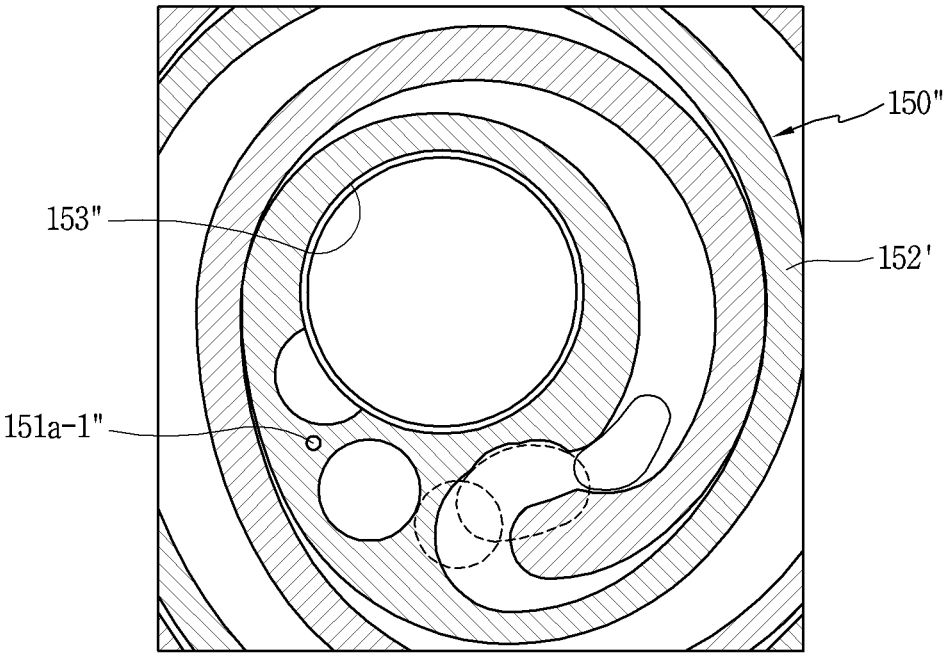
FIG. 5B is a cross-sectional view showing an example in which the orbiting scroll and the fixed scroll of FIG. 5A are engaged with each other.

FIG. 5A is a perspective view showing an orbiting scroll 150" having an R-shaped structure viewed from the bottom, and FIG. 5B is a cross-sectional view showing an example in which the orbiting scroll 150" and the fixed scroll 140" of FIG. 5A are engaged with each other.

In the scroll compressor 100 of the present disclosure, the orbiting scroll 150 can be an orbiting scroll 150" having an R-shaped structure.

In the orbiting scroll 150" having an R-shaped structure, a boss portion 153" is disposed at a central portion of the orbiting end plate portion 151" therethrough in an axial direction.

The rotating shaft 160 is rotatably inserted into and coupled to the boss portion 153". Accordingly, an outer circumferential portion of the boss portion 153" is connected to the orbiting wrap 152" to define a first compression chamber V1 together with the fixed wrap 142" during a compression process.

In the case of the R-shaped orbiting scroll 150", for a back pressure structure, the orbiting back pressure hole 151*a*-1" in a boss portion of the orbiting scroll 150" that is always in contact with the fixed wrap 142" of the fixed scroll 140" can be machined to adjust back pressure.

In some implementations, the orbiting back pressure hole 151*a* may not be limited to the "L" shape as shown in FIG. 2A.

For example, the orbiting back pressure hole 151*a* can be disposed as a straight line between one end portion disposed inside an inner circumference formed by an inner end portion of the orbiting wrap 152 and the other end portion communicating with the back pressure chamber so as to be spaced apart from the orbiting wrap 152 in the orbiting end plate portion 151.

Figure 6A:
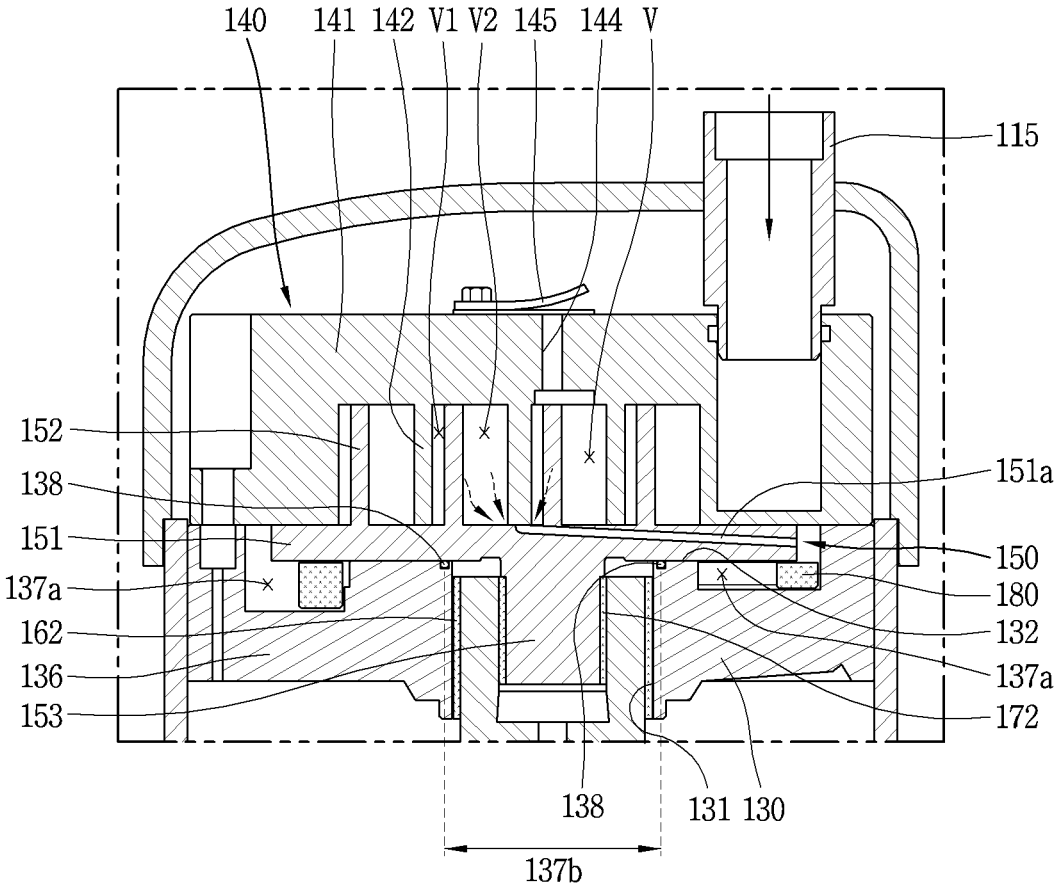
FIG. 6A is a cross-sectional view showing another example of an orbiting back pressure hole.
Figure 6B:
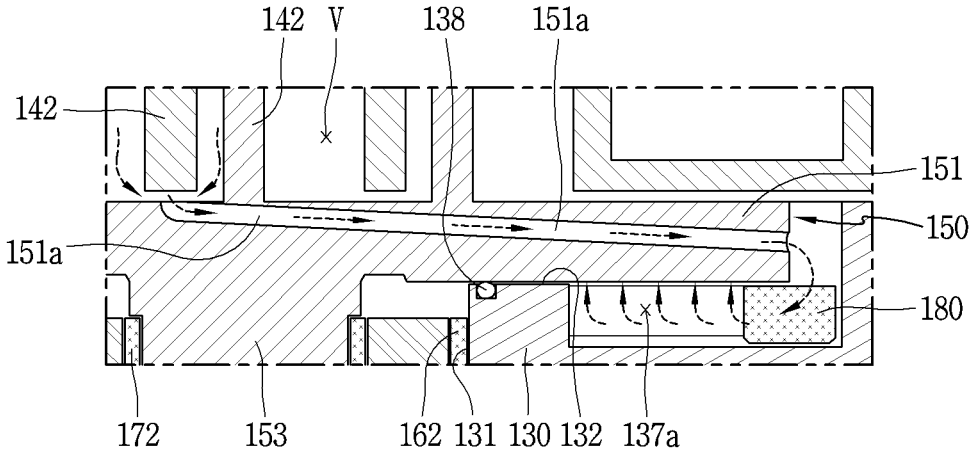
FIG. 6B is a cross-sectional view showing an example in which refrigerant is supplied to a first back pressure chamber through an orbiting back pressure hole through a gap between a fixed wrap and an orbiting end plate portion.

FIG. 6A is a cross-sectional view showing another example of the orbiting back pressure hole 151*a*, wherein an example of the orbiting back pressure hole 151*a* having a diagonal structure is shown in FIG. 6A.

Similar to the "L"-shaped orbiting back pressure hole 151*a*, the "diagonal" orbiting back pressure hole 151*a* of FIG. 6A communicates with the first back pressure chamber 137*a*, and is disposed at one end portion disposed inside an inner circumference formed by an inner end portion of the orbiting wrap 152 so as to be spaced apart from the orbiting wrap 152 in the orbiting end plate portion 151.

It will be understood that the "diagonal" orbiting back pressure hole 151*a* is only different in shape from the "L"-shaped orbiting back pressure hole 151*a*, but the positions at which both end portions are disposed are the same.

As shown in FIG. 6A, as the orbiting back pressure hole 151*a* extends in a diagonal direction, flow distance is reduced compared to the case where high-pressure gas flows through the first and second holes 151*a*-1, 151*a*-2, thereby more quickly supplying the high-pressure gas to the first back pressure chamber.

That is, a left end of the "diagonal" orbiting back pressure hole 151*a* in FIG. 6A can be disposed at a position that is always covered by the fixed wrap 142.

To this end, a thickness of the fixed wrap 142 at one position of the fixed wrap 142 covering the orbiting back pressure hole 151*a* can be twice or more than an orbital radius of the orbiting scroll 150.

Due to this structure, the thickness of a central portion of the fixed wrap 142 is increased to enhance the reliability of the compression unit, thereby solving the rigidity problem of the wrap that occurs while machining the wrap.

In addition, in the scroll compressor 100 of the present disclosure, even when back pressure ratio is not fixed and operating conditions are changed, back pressure can be adjusted according to the operating conditions, thereby increasing the efficiency of the compressor.

Figure 7A:
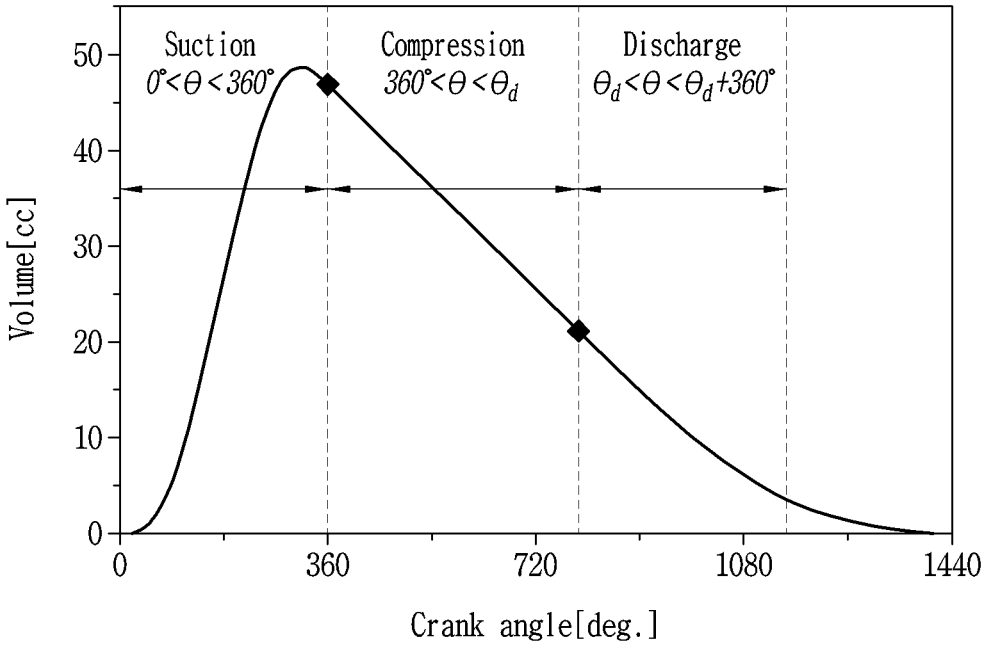
FIG. 7A is a graph showing a volume diagram of an example of a symmetric wrap according to an orbital rotation angle.
Figure 7B:
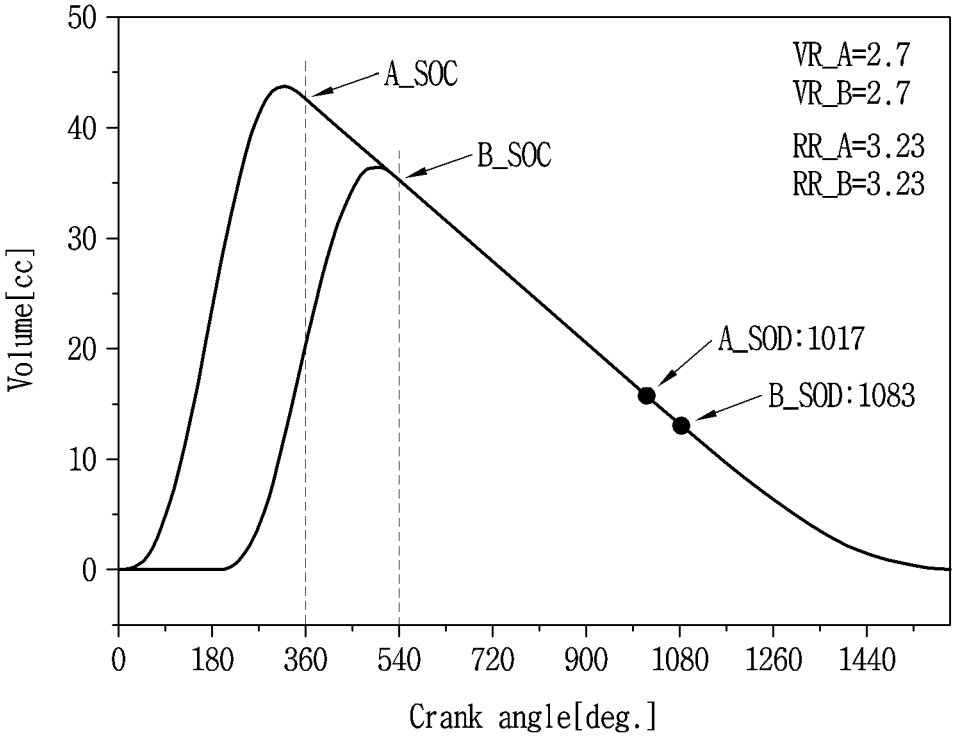
FIG. 7B is a graph showing a volume diagram of an example of an asymmetric wrap according to an orbital rotation angle.

FIG. 7A is a graph showing a volume diagram of a symmetric wrap according to an orbital rotation angle, and FIG. 7B is a graph showing a volume diagram of an asymmetric wrap according to an orbital rotation angle.

Figure 8A:
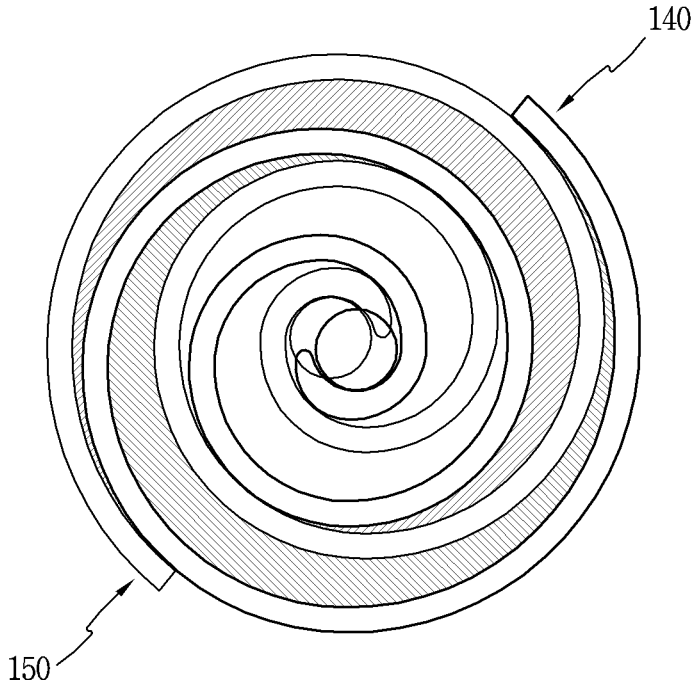
FIG. 8A is a graph showing an example of a symmetric wrap at an orbital rotation angle of 0 degrees.
Figure 8B:
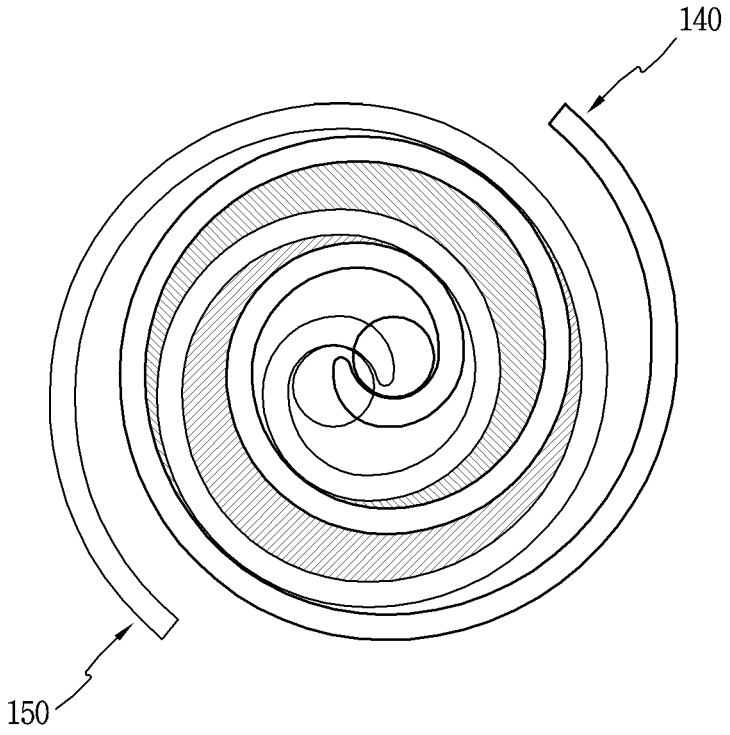
FIG. 8B is a graph showing an example of a symmetric wrap at an orbital rotation angle of 180 degrees.

Furthermore, FIG. 8A is a graph showing a symmetric wrap at an orbital rotation angle of 0 degrees, and FIG. 8B is a graph showing a symmetric wrap at an orbital rotation angle of 180 degrees.

Figure 9A:
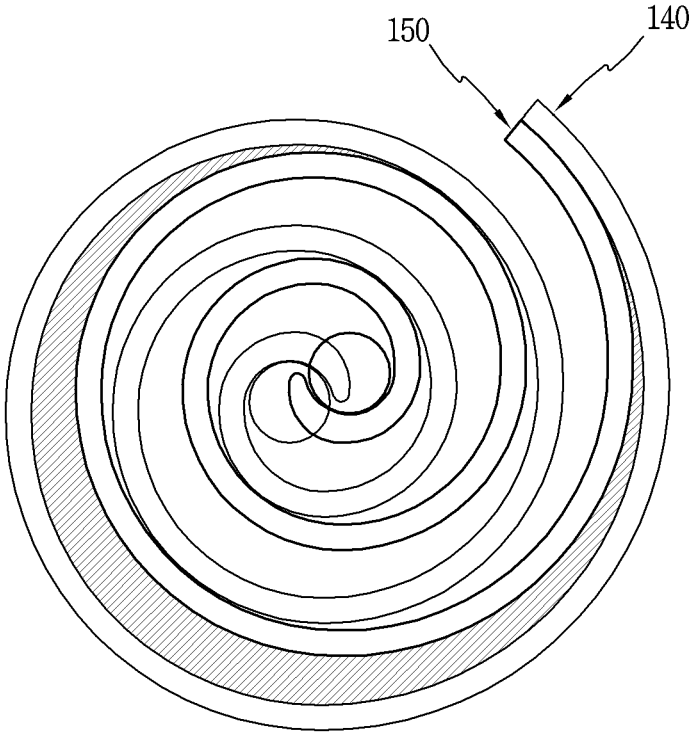
FIG. 9A is a graph showing an example of an asymmetric wrap at an orbital rotation angle of 0 degrees.
Figure 9B:
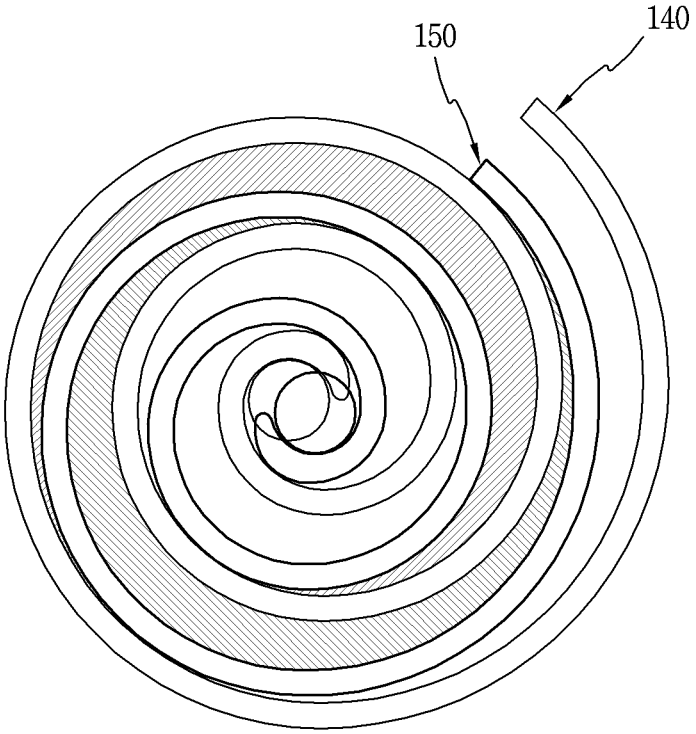
FIG. 9B is a graph showing an example of an asymmetric wrap at an orbital rotation angle of 180 degrees.

In addition, FIG. 9A is a graph showing an asymmetric wrap at an orbital rotation angle of 0 degrees, and FIG. 9B is a graph showing an asymmetric wrap at an orbital rotation angle of 180 degrees.

Referring to FIGS. 7A to 9B, the symmetric wrap and the asymmetric wrap will be described below.

In the case of the fixed back pressure hole 147 in the related art, it is generally applied to an asymmetric wrap, and the fixed back pressure hole 147 is used for the asymmetric compressor.

In this case, the stability of the scroll due to an asymmetric wrap shape is insufficient compared to that of the symmetric scroll.

In addition, when the fixed back pressure hole 147 is additionally applied to the fixed end plate portion 141 of the fixed scroll 140, which is an asymmetric wrap, pressure that has been formed greatly affects the stability of the orbiting scroll 150 while flowing into the back pressure chamber, thereby affecting the reliability of the compressor.

Therefore, the stability of the orbiting scroll 150 can be enhanced by setting the back pressure higher than its setting value, but the high back pressure increases a frictional loss to reduce the efficiency of the compressor.

However, when the adaptive back pressure structure of the present disclosure is applied, the greatest advantage is that the stability of the compressor is increased by minimizing such asymmetry while machining a back pressure hole in the discharge portion regardless of the chamber in which compression is in progress, and as mentioned above, the efficiency of the compressor is increased by maintaining an appropriate back pressure while adapting to appropriate numerical values of back pressure and gas force in the back pressure chamber.

Figure 10A:
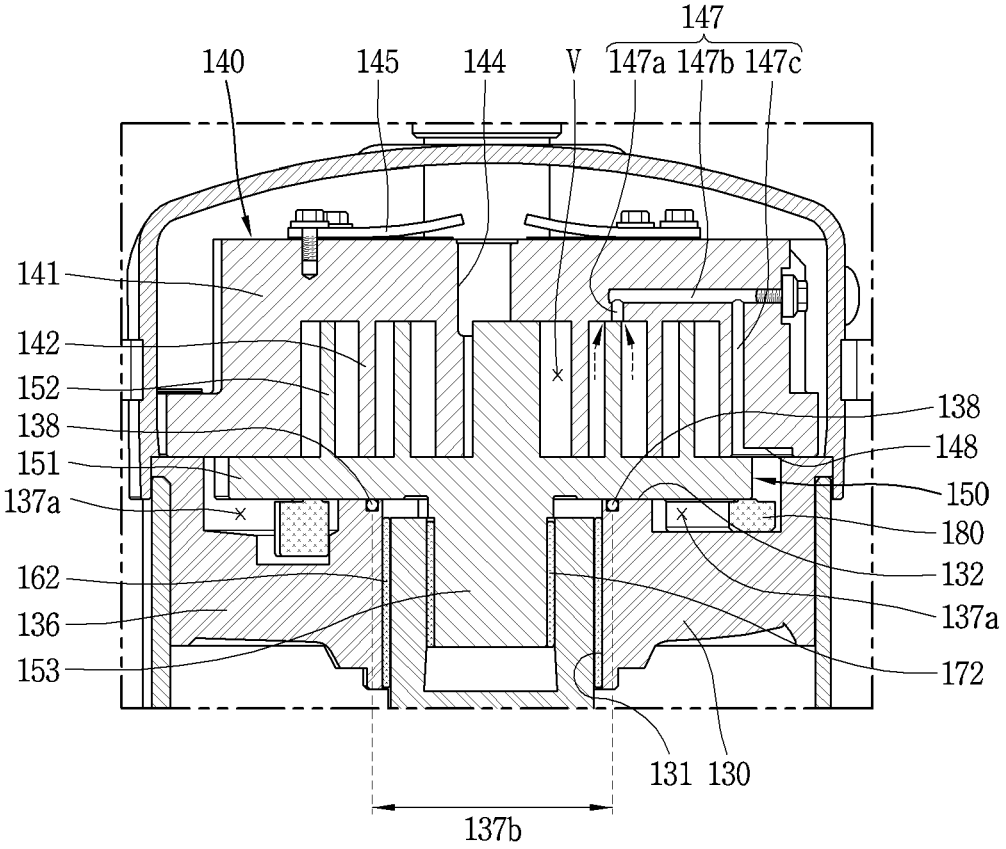
FIG. 10A is a cross-sectional view showing an example in which a fixed back pressure hole is disposed in a fixed end plate portion of a fixed scroll.
Figure 10B:
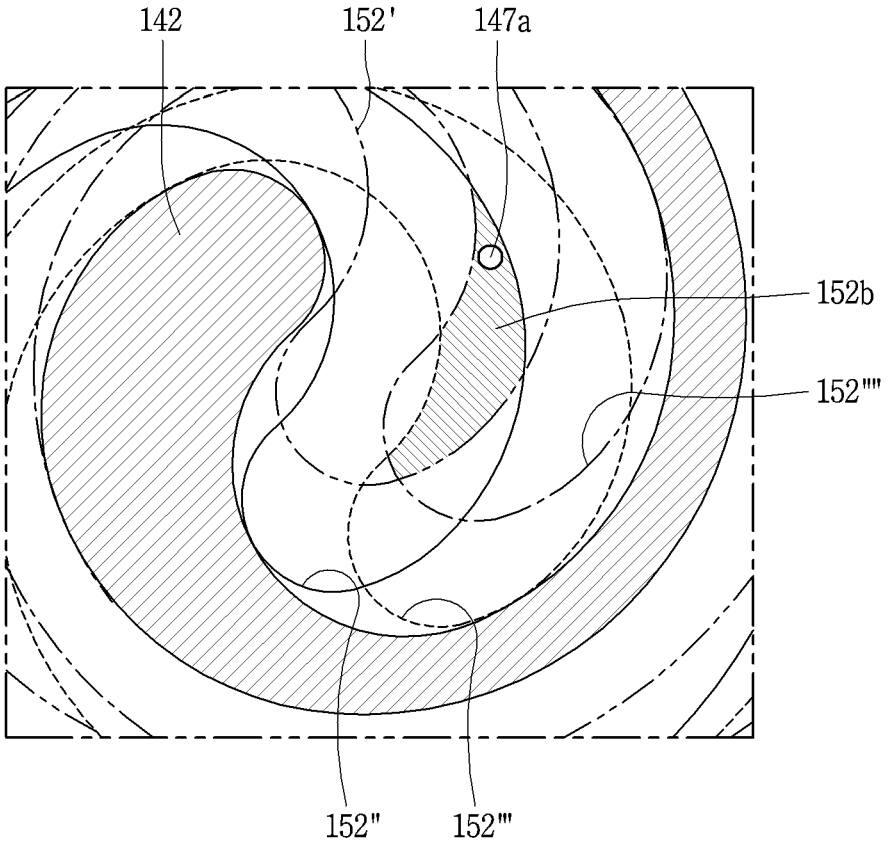
FIG. 10B is a cross-sectional view showing an example of a fixed back pressure hole provided in a fixed end plate portion.

FIG. 10A is a cross-sectional view showing an example in which the fixed back pressure hole 147 is disposed in the fixed end plate portion 141 of the fixed scroll 140, and FIG. 10B is a cross-sectional view showing the fixed back pressure hole 147 provided in the fixed end plate portion 141.

Hereinafter, with reference to FIGS. 10A and 10B, an example in which a back pressure hole is disposed in the fixed end plate portion 141 in the present disclosure will be described. The back pressure hole disposed in the fixed end plate portion 141 can be referred to as a fixed back pressure hole 147.

In this case, one end of the fixed back pressure hole 147 can communicate with the first back pressure chamber 137*a*, and the other end thereof can be disposed to be covered by an end portion of the orbiting wrap 152.

To this end, the fixed back pressure hole 147 can be disposed in a shape that is bent at least once.

Referring to FIG. 10A, it is shown an example in which the fixed back pressure hole 147 is disposed in a shape that is bent twice.

In other words, it will be understood that the fixed back pressure hole 147 is disposed in a shape that is bent twice.

The fixed back pressure hole 147 can include first to third hole portions 147*a*, 147*b*, 147*c* to be disposed in the same shape as above.

One end of the first hole portion 147*a* can be disposed at an end portion of the orbiting wrap 152, and disposed in parallel to an axial direction. The first hole portion 147*a* can be disposed at a position that is always covered by the orbiting wrap 152 of the orbiting scroll 150.

The second hole portion 147*b* can be disposed to communicate with the first hole portion 147*a* to intersect therewith in a lateral direction.

The third hole portion 147*c* can be disposed in parallel to the first hole portion 147*a*, and can communicate between the first back pressure chamber 137*a* and the second hole portion 147*b*.

Referring to FIG. 10A, the first hole portion 147*a* is disposed by a predetermined distance from an inner surface of the fixed end plate portion 141 in a vertical direction, and a lower end of the first hole portion 147*a* is disposed at a position where the orbiting wrap 152 is covered.

An upper end of the first hole portion 147*a* communicates with the second hole portion 147*b*, wherein the second hole portion 147*b* is disposed in a left-right direction. Furthermore, 10A, shows an example in which an upper end of the third hole portion 147*c* communicates with the second hole portion 147*b*, and is disposed in a top-down direction in parallel to the first hole portion 147*a*, and a lower end thereof communicates with the first back pressure chamber 137*a*.

In addition, the fixed back pressure hole 147 can be disposed at an overlapping portion for a plurality of positions, which are relative positions at which the orbiting wrap 152 performs an orbital rotation.

Referring to FIG. 1013, overlapping portions at a plurality of position where the orbiting wrap 152 performs an orbital rotation are indicated by hatched lines, wherein one end of the fixed back pressure hole 147 can be located at an overlapping portion for a plurality of positions where the orbiting wrap 152 performs an orbital rotation.

For example, when the fixed back pressure hole 147 includes first through third hole portions 147*a*, 147*b*, 147*c*, one end of the first hole portion 147*a* can be located at overlapping portion for a plurality of positions where the orbiting wrap 152 performs an orbital rotation.

The plurality of positions where the orbiting wrap 152 performs an orbital rotation can be positions at specific orbital angles among traces of movement when the orbiting scroll 150 performs an orbital rotation in the fixed scroll 140.

Referring to FIG. 10B, positions at which the orbital rotation angles of the orbiting scroll 150 are 0 degrees, 90 degrees, 180 degrees, and 270 degrees, respectively, and overlapping portions therebetween are shown as hatched lines.

As one end of the fixed back pressure hole 147, For example, the first hole portion 147*a* is located at an overlapping portion between a plurality of positions at which the orbiting scroll 150 is rotated, even when the orbiting scroll 150 performs an orbital rotation, the fixed back pressure hole 147 is always at a position covered by the orbiting wrap 152 to allow the aforementioned adaptive back pressure.

Figure 10C:
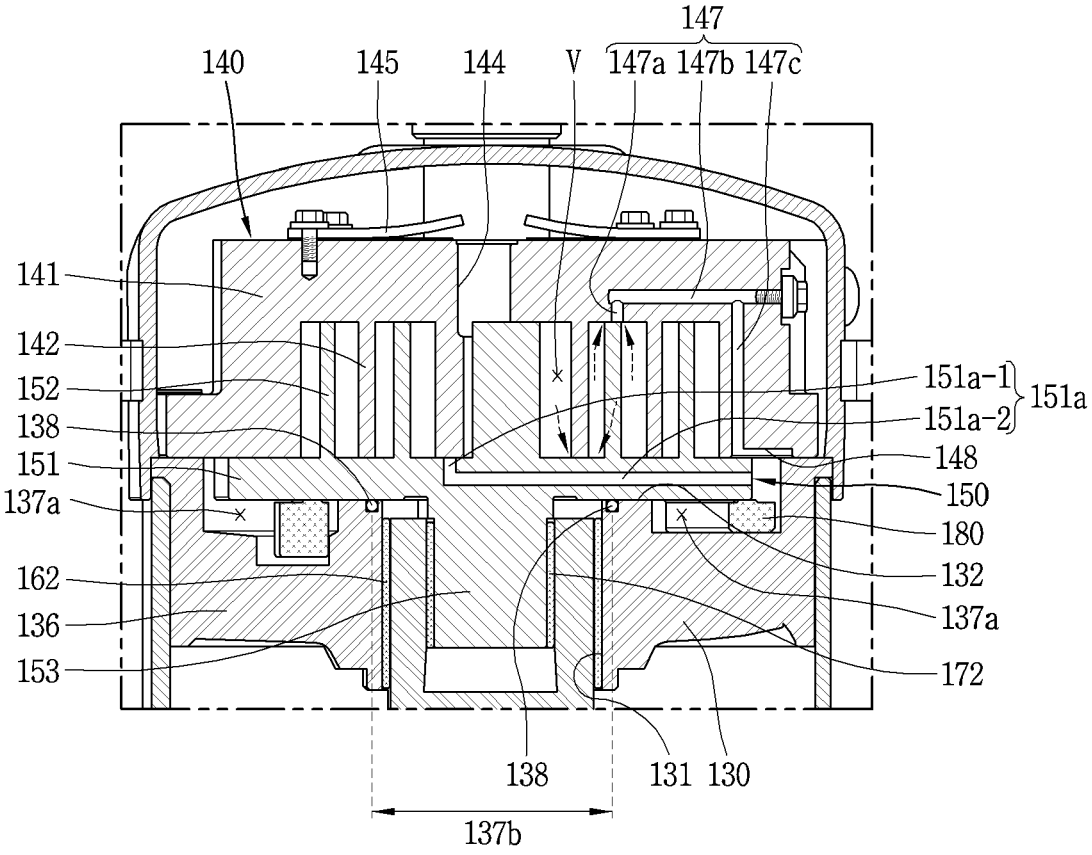
FIG. 10C is a cross-sectional view showing an example in which an orbiting back pressure hole including first and second holes of a fixed scroll and a fixed back pressure hole are disposed in a fixed end plate portion.
Figure 10D:
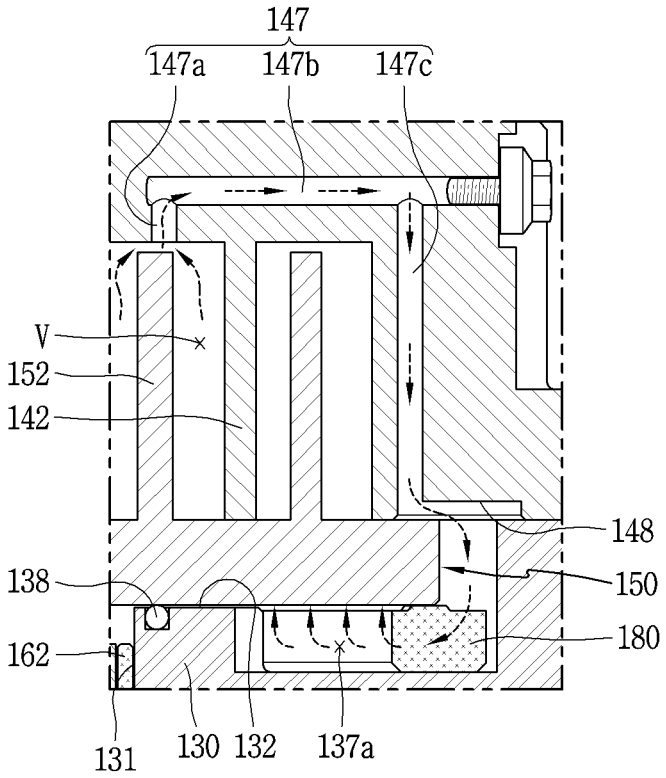
FIG. 10D is a cross-sectional view showing an example in which refrigerant is supplied to a first back pressure chamber through a fixed back pressure hole through a gap between an orbiting wrap and a fixed end plate portion.

Furthermore, FIG. 10D is a cross-sectional view showing an example in which refrigerant is supplied to the first back pressure chamber 137*a* through the fixed back pressure hole 147 through a gap between the orbiting wrap 152 and the fixed end plate portion 141, wherein referring to FIG. 10D, when the orbiting scroll 150 is pushed in an axial direction (downward direction in FIG. 10D) due to a low back pressure in the first back pressure chamber 137*a*, a gap is generated between the fixed scroll 140 and the orbiting scroll 150 to flow gas in the compression chamber through the first to third hole portions 147*a*, 147*b*, 147*c* to be supplied to the first back pressure chamber 137*a*, thereby allowing adaptive back pressure.

In addition, referring to FIG. 10C, it is shown the scroll compressor 100 having the fixed back pressure hole 147 provided in the fixed end plate portion 141, one end of which is disposed to communicate with the first back pressure chamber 137*a*, and the other end of which is disposed in a shape that is bent at least once so as to be always covered by an end portion of the orbiting wrap 152, wherein the orbiting back pressure hole 151*a* is disposed in the orbiting end plate portion 151, and the orbiting back pressure hole 151*a* includes a first hole 151*a*-1 disposed in parallel to the rotating shaft 160; and a second hole portion 147*b* disposed in a lateral direction to communicate between one end of the first hole 151*a*-1 and the first back pressure chamber 137*a*, and the first hole 151*a*-1 is located between outer and inner circumferences at one position of the fixed wrap 142 so as to be always covered by the fixed wrap 142.

In the example of FIG. 10C, as mentioned above, a thickness of the fixed wrap 142 at one position of the fixed wrap 142 covering the first hole 151*a*-1 can be twice or more than an orbiting radius of the orbiting scroll 150.

In addition, it has already been described above that the fixed scroll 140 is a high-pressure scroll in which the refrigerant suction pipe 115 is coupled to communicate with the compression chamber.

A thickness of an end portion of the orbiting wrap 152 covering the fixed back pressure hole 147 can be twice or more than an orbiting radius at which the orbiting scroll 150 performs an orbital rotation.

Furthermore, the fixed back pressure hole 147 can be disposed at an overlapping portion at a plurality of positions, which are relative positions at which the orbiting wrap 152 performs an orbital rotation, wherein the plurality of positions are 0 degrees, 90 degrees, 180 degrees, and 270 degrees, respectively.

The fixed back pressure hole 147 can include a first hole portion 147*a*, one end of which is disposed at an end portion of the orbiting wrap 152 and disposed in parallel to the axial direction; a second hole portion 147*b* disposed to communicate with the first hole portion 147*a* in a lateral direction; and a third hole portion 147*c* disposed in parallel to the first hole portion 147*a* to communicate between the first back pressure chamber 137*a* and the second hole portion 147*b*.

In addition, the fixed scroll 140 can be provided with a guide inlet portion 148 disposed between the fixed back pressure hole 147 and the first back pressure chamber 137*a* to guide the inflow of gas from the fixed back pressure hole 147 to the first back pressure chamber 137*a*.

In this manner, FIG. 10C shows the scroll compressor 100 in accordance with an example in which the orbiting back pressure hole 151*a* includes the first and second holes 151*a*-1, 151*a*-2, and the fixed back pressure hole 147 is provided therein as well.

In connection with the example of FIG. 10C, the previous description will be substituted for a portion that is not described for the orbiting back pressure hole 151*a* and the fixed back pressure hole 147.

Figure 10E:
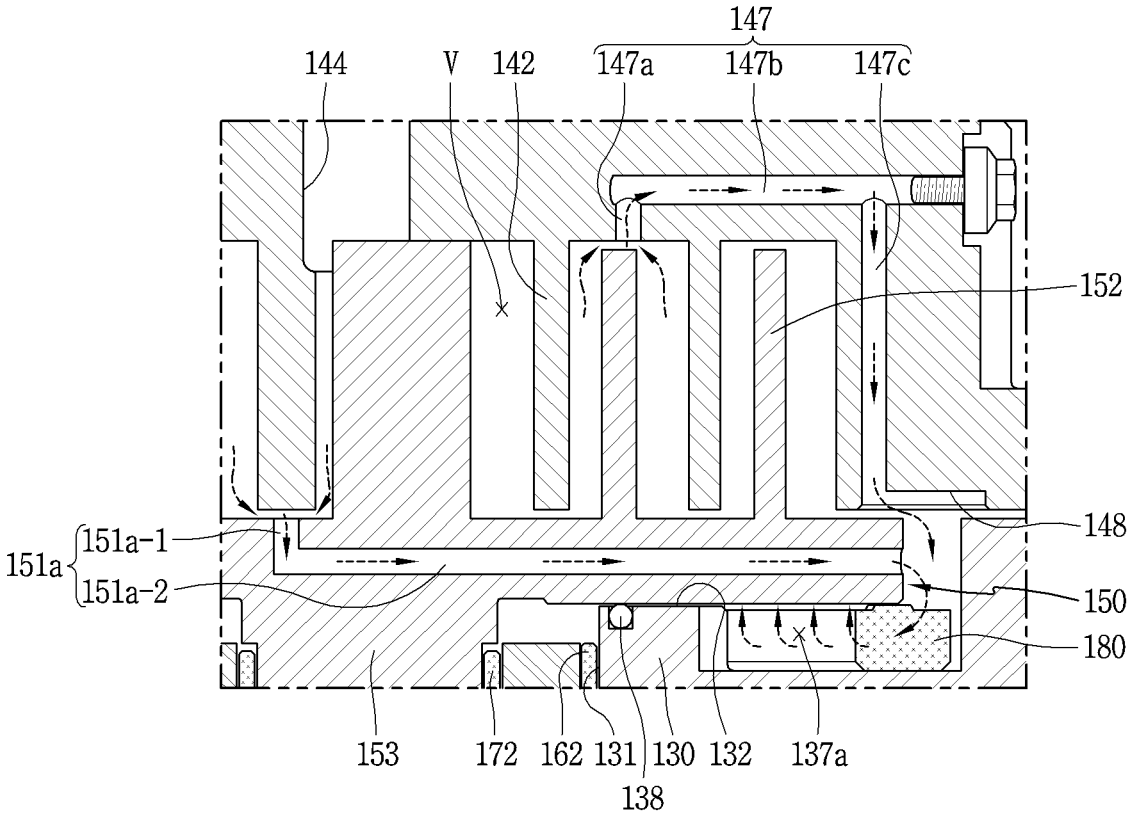
FIG. 10E is a cross-sectional view showing an example in which refrigerant is supplied to a first back pressure chamber through an orbiting back pressure hole through a gap between a fixed wrap and an orbiting end plate portion, and refrigerant is supplied to the first back pressure chamber through a fixed back pressure hole through a gap between an orbiting wrap and a fixed end plate portion.

In addition, FIG. 10E is a cross-sectional view showing an example in which refrigerant is supplied to the first back pressure chamber 137*a* through the orbiting back pressure hole 151*a* through a gap between the fixed wrap 142 and the orbiting end plate portion 151, and refrigerant is supplied to the first back pressure chamber 137*a* through the fixed back pressure hole 147 through a gap between the orbiting wrap 152 and the fixed end plate portion 141, wherein referring to FIG. 10E, when the orbiting scroll 150 is pushed in an axial direction (downward direction in FIG. 10E) due to a low back pressure in the first back pressure chamber 137*a*, a gap is generated between the fixed scroll 140 and the orbiting scroll 150 to flow gas in the compression chamber through the first to third hole portions 147*a*, 147*b*, 147*c* to be supplied to the first back pressure chamber 137*a*, and refrigerant is supplied to the first back pressure chamber 137*a* through the first second holes 151*a*-1, 151*a*-2 of the orbiting back pressure hole 151*a*, thereby allowing adaptive back pressure.

In some implementations, the rotating shaft coupling portion 153 coupled to the rotating shaft 160 is provided on a lower surface of the orbiting end plate portion 151, thereby allowing the orbiting scroll 150 to perform an orbital rotation by the rotation of the rotating shaft 160.

An orbiting bearing 172 can be provided between an inner circumference of the rotating shaft coupling portion 153 and an outer circumference of the rotating shaft 160.

In some examples, an Oldham ring 180 can be provided between the fixed scroll 140 and the orbiting scroll 150 to prevent rotation of the orbiting scroll 150.

Hereinafter, the low-pressure scroll compressor 200 of the present disclosure will be described.

Figure 11:
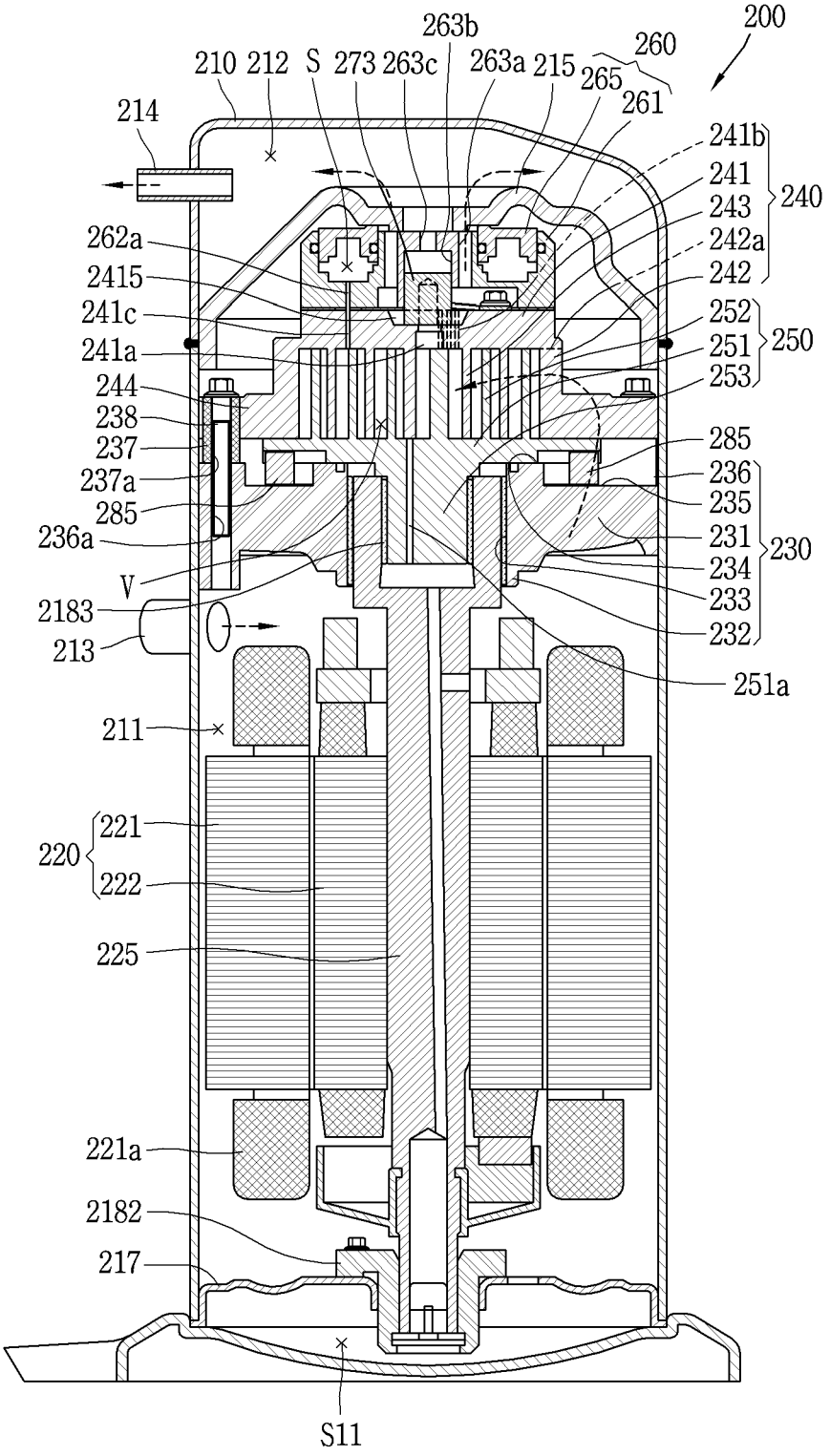
FIG. 11 is a cross-sectional view showing an example of a low-pressure scroll compressor low of the present disclosure.
Figure 12A:
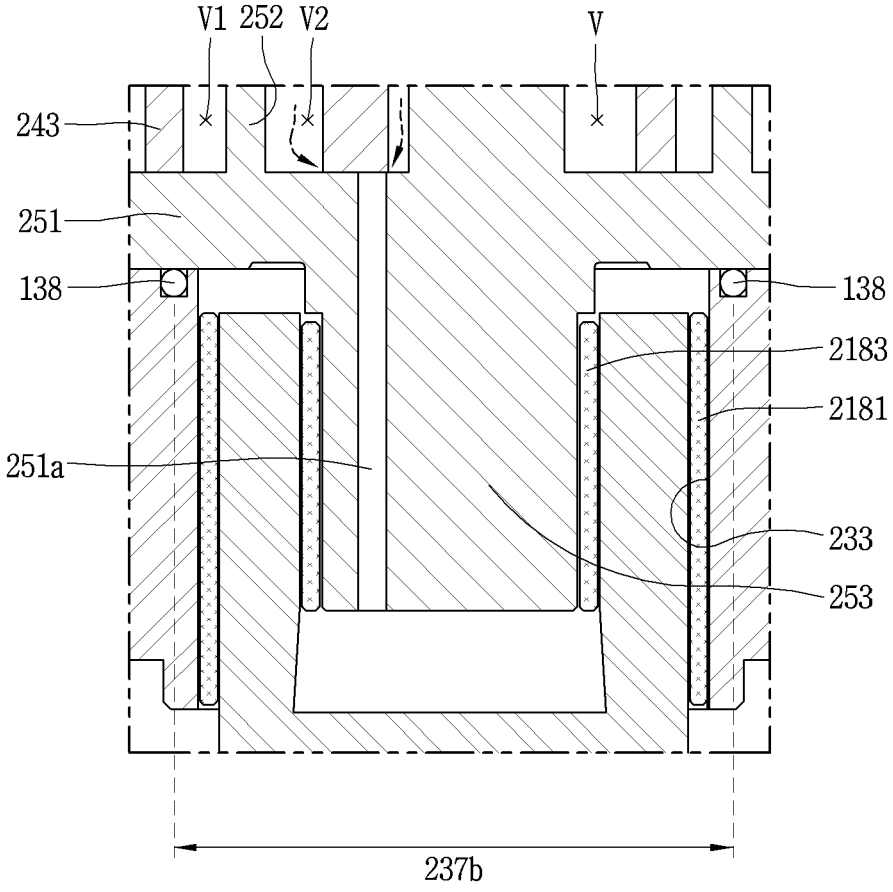
FIG. 12A is a cross-sectional view showing an example of a back pressure hole disposed to pass through a rotating shaft coupling portion up to a lower end thereof from an orbiting end plate portion.
Figure 12B:
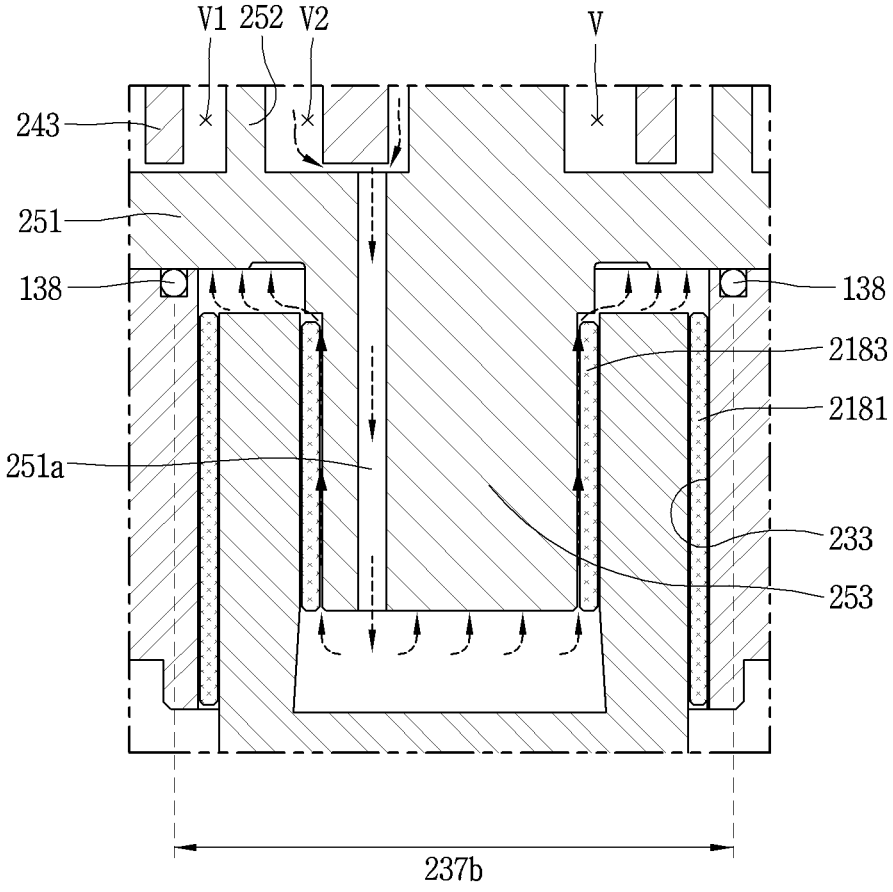
FIG. 12B is a cross-sectional view showing an example in which refrigerant is supplied to a second back pressure chamber through an orbiting back pressure hole through a gap between a non-orbiting wrap and an orbiting end plate portion.

FIG. 11 is a cross-sectional view showing the low-pressure scroll compressor 200 of the present disclosure, and FIG. 12A is a cross-sectional view showing an orbiting back pressure hole 251*a* disposed to pass through a rotating shaft coupling portion 253 up to a lower end thereof from an orbiting end plate portion 251. FIG. 12B is a cross-sectional view showing an example in which refrigerant is supplied to a second back pressure chamber 237*b* through the orbiting back pressure hole 251*a* through a gap between the non-orbiting wrap 243 and the orbiting end plate portion 251.

Figure 13:
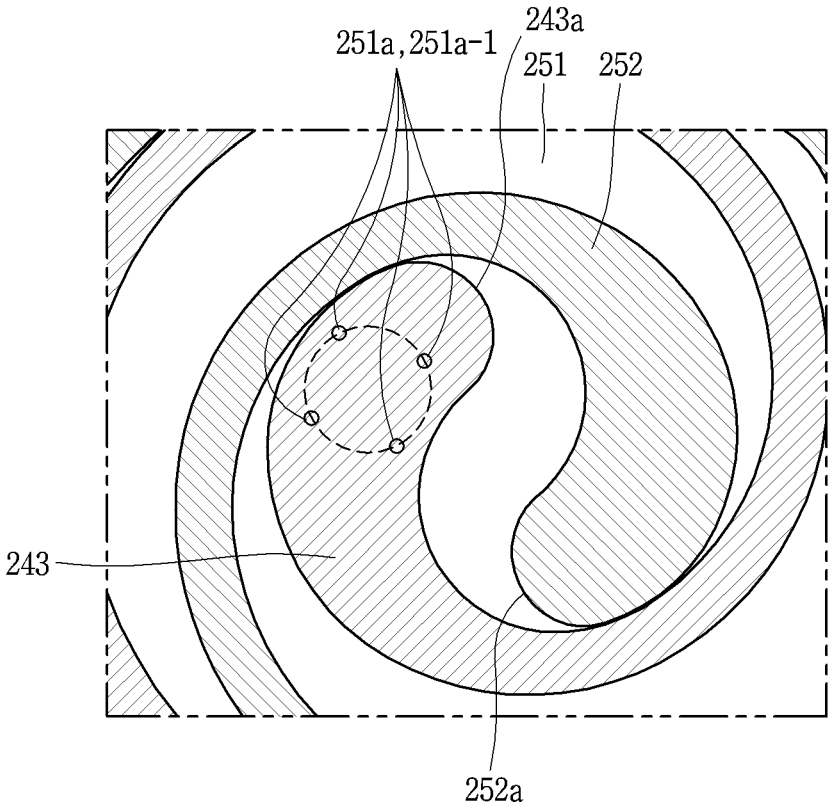
FIG. 13 is an enlarged cross-sectional view showing an example in which a back pressure hole is disposed to be covered by a fixed wrap of a fixed scroll when the orbiting scroll of FIG. 12A performs an orbital rotation.
Figure 14A:
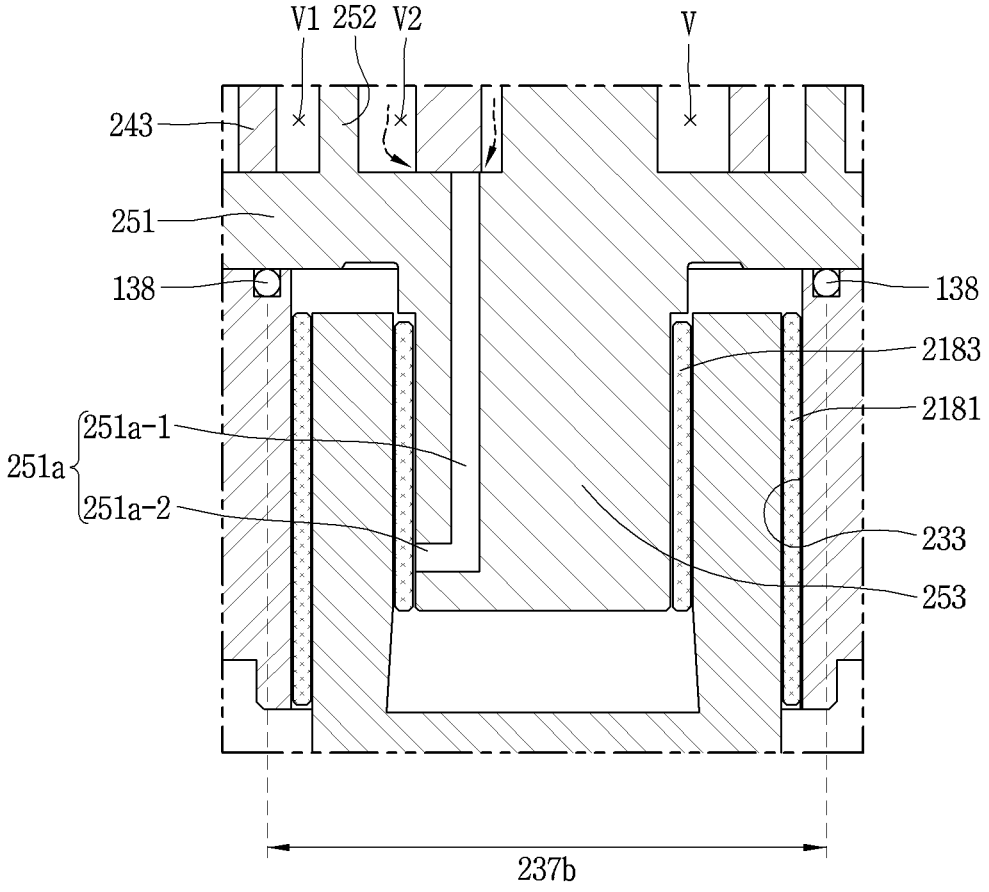
FIG. 14A is a cross-sectional view showing an example of a back pressure hole disposed in a lateral direction of a rotating shaft coupling portion in an orbiting end plate portion.
Figure 14B:
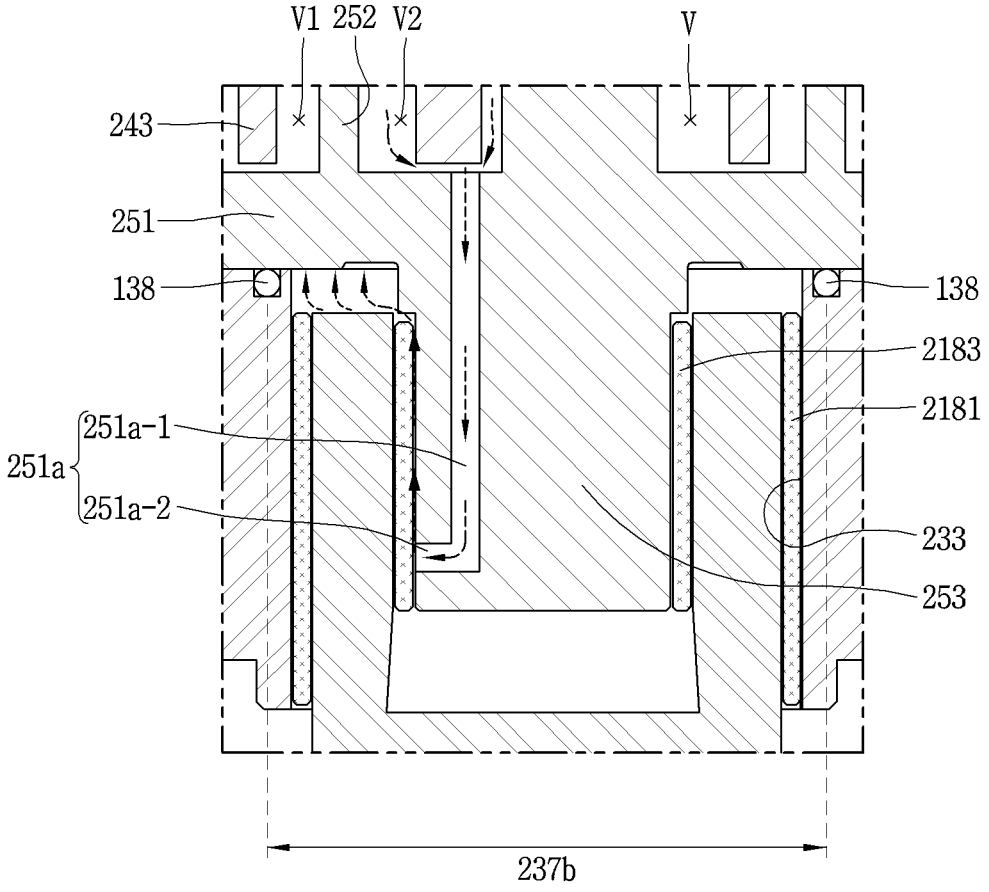
FIG. 14B is a cross-sectional view showing an example in which refrigerant is supplied to a second back pressure chamber through an orbiting back pressure hole through a gap between a non-orbiting wrap and an orbiting end plate portion.

In addition, FIG. 13 is an enlarged cross-sectional view showing an example in which a back pressure hole is disposed to be covered by the non-orbiting wrap 243 of the non-orbiting scroll 250 when the orbiting scroll 250 of FIG. 12A performs an orbital rotation, and FIG. 14A is a cross-sectional view showing a back pressure hole disposed in a lateral direction of the rotating shaft coupling portion 253 in the orbiting end plate portion 251. FIG. 14B is a cross-sectional view showing an example in which refrigerant is supplied to a second back pressure chamber 237*b* through the orbiting back pressure hole 251*a* through a gap between the non-orbiting wrap 243 and the orbiting end plate portion 251.

Hereinafter, with reference to FIGS. 11 to 14A, the structure of the orbiting back pressure hole 251*a* capable of communicating with the second back pressure chamber 237*b* in the low-pressure scroll compressor 200 of the present disclosure will be described.

Referring to FIG. 11, the scroll compressor 200 of the present disclosure includes a casing 210, a drive motor 220 provided inside the casing 210, a rotating shaft 225 rotatably coupled to the drive motor 220, an orbiting scroll 250 having an orbiting end plate portion 251, an orbiting wrap 252 protruding in a spiral shape from one surface of the orbiting end plate portion 251, and a rotating shaft coupling portion 253 protruding from the other surface of the orbiting end plate portion 251 to be coupled to an end portion of the rotating shaft 225, a non-orbiting scroll 250 having a non-orbiting wrap 243 engaged with the orbiting wrap 252 to form a compression chamber with the orbiting wrap 252 therebetween, and a main frame 230 having a second back pressure chamber 237*b* at a predetermined distance from the center of the orbiting end plate portion 251 to rotatably support the orbiting scroll 250.

An orbiting back pressure hole 251*a* is disposed in the orbiting end plate portion 251, wherein one end of the orbiting back pressure hole 251*a* is disposed to communicate with the second back pressure chamber 237*b*.

In addition, the other end of the orbiting back pressure hole 251*a* is located between outer and inner circumferences at one position of the non-orbiting wrap 243 so as to be always covered by the non-orbiting wrap 243.

As a result, in the scroll compressor 200 of the present disclosure, in order to maintain a gap between the orbiting scroll 250 and the non-orbiting scroll 250, the second back pressure chamber 237*b* can receive an intermediate back pressure instead of discharge pressure, where the back pressure hole 251*a* transmits pressure to the second back pressure chamber 237*b* by a "straight" structure in a vertical direction to maintain an intermediate pressure.

More specifically, with reference to FIG. 12 of the orbiting end plate portion, when the orbiting scroll is pushed downward due to a high pressure in the compression chamber V, discharge pressure in the compression chamber V between the fixed wrap and the orbiting end plate portion flows to the second back pressure chamber through the orbiting back pressure hole 251*a* in an axial direction. At this time, due to a pressure drop by pressure and flow loss in the orbiting back pressure hole 251*a* and an increase in the second back pressure chamber space by a pressure inflow into the second back pressure chamber, discharge pressure may not be completely provided, but an intermediate pressure slightly lower than the discharge pressure can be provided to the second back pressure chamber, and the second back pressure chamber can maintain an intermediate pressure.

At this time, if the orbiting back pressure hole 251*a* disposed in the orbiting end plate portion 251 is not disposed to be always covered by the non-orbiting wrap 243, then the orbiting back pressure hole 251*a* is exposed to the compression chamber and introduced into the second back pressure chamber 237*b* in the compression chamber to allow the pressure in the second back pressure chamber 237*b* to be the same as the discharge pressure, and as a result, it can be difficult to maintain a gap between the orbiting scroll 250 and the non-orbiting scroll 250, thereby preventing the function of the second back pressure chamber 237*b* from being properly performed.

Therefore, the orbiting back pressure hole 251*a* disposed in the orbital end plate portion 251 needs to be always covered by the non-orbiting wrap 243.

In addition, even when back pressure ratio is not fixed and operating conditions are changed, back pressure can be adjusted according to the operating conditions, thereby increasing the efficiency of the compressor.

The orbiting back pressure hole 251*a* can be disposed in parallel to the rotating shaft 225, and disposed to pass through the rotating shaft coupling portion 253 up to a lower end thereof.

In addition, the orbiting back pressure hole 251*a* can be disposed inside an inner circumference formed by an inner end portion of the orbiting wrap 252 to be spaced apart from the orbiting wrap 252 in the orbiting end plate portion 251.

Referring to FIG. 12A, it is shown an example in which the orbiting back pressure hole 251*a* is disposed in a vertical direction to pass through the rotating shaft coupling portion 253 up to a lower end thereof so as to communicate with the second back pressure chamber 237*b*.

Referring to FIG. 12B, it is shown an example in which while the non-orbiting wrap 243 and the orbiting end plate portion 251 are spaced apart due to the orbiting scroll being pushed in an axial direction (downward), pressure is transmitted to the second back pressure chamber 237*b* through the orbiting back pressure hole 251*a* to maintain an intermediate pressure.

The orbiting back pressure hole 251*a* can be disposed at an inner side of the orbiting end plate portion 251 so as to be covered by an inner end portion of the non-orbiting wrap 243, and a thickness of the end portion of the non-orbiting wrap 243 covering the orbiting back pressure hole 251*a* can be twice or more than an orbiting radius at which the orbiting scroll 250 rotates in an orbital path.

Referring to FIG. 13, the orbiting diameter of the orbiting scroll 250 at positions of 0 degrees, 90 degrees, 180 degrees, and 270 degrees is 10.4 mm. In the non-orbiting scroll 250, a width of the fixed wrap 243 can be approximately 13.1 mm, and a width of the orbiting wrap 252 of the orbiting scroll 250 can be approximately 13.1 mm similar to the width of the non-orbiting wrap 243 of the non-orbiting scroll 250.

Therefore, the orbiting radius of the orbiting scroll 250 is 5.2 mm, which is a half of the orbiting diameter (20.4 mm) of the orbiting scroll 250.

In this manner, referring to FIG. 13, the width of the non-orbiting wrap 243 of the non-orbiting scroll 250 is disposed to be twice the orbiting radius of the orbiting scroll 250, and thus the orbiting back pressure hole 251*a* can be placed at a position that is always covered by the non-orbiting wrap 243.

Furthermore, with this structure, the orbiting back pressure hole 251*a* is located between outer and inner circumferences at one position of the non-orbiting wrap 243.

Due to this, a thickness of the central portion becomes larger by a structure that always covers the back pressure hole, thereby increasing the reliability of the compression unit, and solving the problem of rigidity of the wrap that occurs while machining the wrap.

Referring to FIG. 13, the orbiting back pressure hole 251*a* can be disposed in the orbiting end plate portion 251 to be spaced apart from the orbiting wrap 252 inside an inner circumference formed by an inner end portion of the orbiting wrap 252.

As mentioned above, the orbiting back pressure hole 251*a* can always be disposed at a position covered by the non-orbiting wrap 243 of the non-orbiting scroll 240, and for this purpose, the orbiting back pressure hole 251*a* is disposed inside an inner circumference of an inner end portion of the orbiting wrap 252 of FIG. 13, and can be disposed to be spaced apart from the orbiting wrap 252 in the orbiting end plate portion 251.

In addition, although four orbiting back pressure holes 251*a* are disposed in FIG. 13, these four orbiting back pressure holes 251*a* show moving traces at four places where one orbiting scroll 250 performs an orbital rotation, but may not be limited to a case that the number of orbiting back pressure holes 251*a* is four.

In some examples, the orbiting back pressure hole 251*a* may not be limited to one hole, but rather it can be one of a plurality of holes spaced apart from one another in some implementations.

The orbiting back pressure hole 251*a* may not be limited to a structure that is disposed to pass through the rotating shaft coupling portion 253 up to a lower end thereof.

For instance, the orbiting back pressure hole 251*a* can include first and second passages 251*a*-1, 251*a*-2.

Referring to FIG. 14A, the first passage 251*a*-1 can be disposed in an axial direction by a predetermined distance from the rotating shaft coupling portion 253.

In addition, the second passage 251*a*-2 is disposed in a direction intersecting with the first passage 251*a*-1, and can communicate between the first passage 251*a*-1 and the second back pressure chamber 237*b*.

Due to a structure in which the orbiting back pressure hole 251*a* includes the first and second passages 251*a*-1, 251*a*-2, pressure in the compression chamber can flow into the second back pressure chamber 237*b* in a lateral direction, thereby allowing the second back pressure chamber 237*b* to maintain an intermediate pressure.

Referring to FIG. 14B, it is shown an example in which while the non-orbiting wrap 243 and the orbiting end plate portion 251 are spaced apart due to the orbiting scroll being pushed in an axial direction (downward), pressure is transmitted to the second back pressure chamber 237*b* in a lateral direction through the first and second passages 251*a*-1, 251*a*-2 of the orbiting back pressure hole 251*a* to maintain an intermediate pressure.

Hereinafter, a detailed configuration of the low-pressure scroll compressor 200 of FIG. 11 will be described.

The casing 210 is configured to have a sealed inner space. An inner space of the casing 210 can include a suction space 211 formed at a relatively low pressure and a discharge space 212 formed at a relatively high pressure. The casing 210 can have, For example, a cylindrical shape.

The casing 210 can include a high and low pressure separation plate 215 provided inside the casing 210 to separate the suction space 211 and the discharge space 212. The high and low pressure separation plate 215 can be provided above the non-orbiting scroll 240 to be described later, for an example. FIG. 11 shows that the discharge space 212 is located in an inner space of the casing 210 provided above the high and low pressure separation plate 215, and the suction space 211 is located in an inner space of the casing 210 provided below the high and low pressure separation plate 215.

In addition, the casing 210 can include a suction pipe 213 capable of communicating between the suction space 211 and the outside, and a discharge pipe 214 capable of communicating between the discharge space 212 and the outside.

The suction pipe is coupled to the casing 210 at one height spaced apart from the non-orbiting scroll 250, and refrigerant introduced through the suction pipe flows into the compression chamber through an inside of the casing 210.

A drive motor 220 including a stator 221 and a rotor 222 can be disposed in a suction space of the casing 210. The stator 221 is shrink-fixed to an inner circumferential surface of the casing 210, and the rotor 222 is rotatably provided inside the stator 221.

A drive motor 220 including a stator 221 and a rotor 222 can be disposed in a suction space of the casing 210. The stator 221 is shrink-fixed to an inner circumferential surface of the casing 210, and the rotor 222 is rotatably provided inside the stator 221.

A coil 221*a* is wound around the stator 221, wherein the coil 221*a* is electrically connected to an external power source, which supplies power, through a terminal coupled to the casing 210 therethrough. The rotating shaft 225 is inserted into and coupled to the center of the rotor 222.

Upper and lower end portions of the rotating shaft 225 are rotatably inserted into and coupled to the main frame 230 and the sub frame 217, respectively, and as a result, the rotating shaft 225 rotates while being supported in a radial direction. A main bearing 2183 and a sub bearing 2182 for supporting the rotating shaft 225 are respectively inserted into and coupled to the main frame 230 and the sub frame 217. For example, the main bearing 2183 and the sub bearing 2182 can each be a bush bearing.

The main frame 230 rotatably supports the orbiting scroll 250 at an opposite side of the non-orbiting scroll 240 with the orbiting scroll 250 therebetween, and is supportably connected to the non-orbiting scroll 240.

The main frame 230 can be configured with a scroll fixing portion 236 that allows non-orbiting to support the non-orbiting scroll 240. Furthermore, the scroll fixing portion 236 can include a fastening hole 236*a* for fixing the non-orbiting scroll 240.

The scroll fixing portions 236 is disposed in plural along a circumferential direction of the main frame 230, wherein an example in which four scroll fixing portions 236 are disposed along the circumferential direction of the main frame 230 is shown in FIG. 2. However, in some examples, three scroll fixing portions 236 can be disposed along the circumferential direction of the main frame 230 can also be allowed.

In addition, the main frame 230 includes an orbiting space portion 233, which is formed therein to accommodate the rotating shaft coupling portion 253 so as to perform an orbital motion, and a scroll support surface 234 disposed around the orbiting space portion 233 in an annular shape to have a predetermined width on an upper surface of the main frame 230.

The main frame 230 includes a main flange portion 231 fixedly coupled to an inner wall surface of the casing 210. A main bearing portion 232 disposed to protrude downward toward the drive motor 220 is provided below the main flange portion 231.

An example in which a shaft receiving hole 232*a* is disposed to pass through the main bearing portion 232 in an axial direction so as to allow the rotating shaft 225 to be inserted thereinto, and a main bearing 2183 configured with a bush bearing is inserted into and fixedly coupled to an inner circumferential surface of the shaft receiving hole 232*a* is shown. The rotating shaft 225 is inserted into the main bearing 2183, wherein the rotating shaft 225 can rotate while being supported in a radial direction by the main bearing 2183.

A scroll support surface 234 for supporting the orbiting scroll 250 in an axial direction is provided on an upper surface of the main flange portion 231, and an orbiting space portion 233 capable of accommodating the rotating shaft coupling portion 253 of the orbiting scroll 250 in an orbital manner is provided inside the main flange portion 231. In addition, an Oldham ring accommodating portion 235 for accommodating an Oldham ring 280 in an orbital manner is disposed outside the scroll support surface 234, and the scroll fixing portion 236 for supporting the non-orbiting scroll 240 in axial and radial directions is disposed outside the Oldham ring accommodating portion 235.

The orbiting scroll 250 is configured to perform an orbital motion. The rotating shaft coupling portion 253 into which the rotating shaft 225 rotatable by external power is inserted is disposed on one surface of the orbiting scroll 250, wherein an example in which the rotating shaft coupling portion 253 is disposed on a bottom surface of the orbiting end plate portion 251 of the orbiting scroll 250 is shown in FIG. 2.

The non-orbiting scroll 240 includes a non-orbiting end plate portion 241 disposed in a disk shape to constitute an upper portion of the non-orbiting scroll 240, a non-orbiting side wall portion 242 protruding downward in an annular shape from a lower surface edge of the non-orbiting end plate portion 241, and a non-orbiting wrap 243 provided on a lower surface of the non-orbiting end plate portion 241 inside the non-orbiting side wall portion 242 and engaged with the orbiting wrap 252 to form a pair of two compression chambers V1, V2.

A suction port 242*a* for allowing refrigerant in the suction space 211 to be suctioned into the suction pressure chamber (no reference numeral) is disposed on a side surface of the non-orbiting side wall portion 242, and a discharge port 241*a* for allowing compressed refrigerant to be discharged from the discharge pressure chamber (no reference numeral) toward the discharge space 212 is disposed at a substantially central portion of the non-orbiting end plate portion 241. FIG. 2 shows an example in which a suction port 242*a* provided in a shape that is cut by a predetermined length is disposed along a side surface of the non-orbiting side portion and a circular discharge port 241*a* is disposed in a central portion of the non-orbiting end plate portion 241.

The discharge port 241*a* is disposed at a position where the discharge pressure chamber (no reference numeral) of the first compression chamber V1 and the discharge pressure chamber (no reference numeral) of the second compression chamber V2 communicate with each other, and a discharge guide groove 2415 to be described later is disposed around the discharge port 241*a*. Accordingly, an axial length of the discharge port 241*a* is disposed to be smaller than that of the non-orbiting end plate portion 241.

In addition, a bypass hole is disposed in the non-orbiting end plate portion 241, wherein the bypass hole 241*c* is disposed between the suction port 242*a* and the discharge port 241*a*, that is to say, to pass through the non-orbiting end plate portion 241 in an axial direction from the intermediate pressure chamber (no reference numeral) so as to communicate with an intermediate discharge port 263*a* to be described later. Accordingly, a portion of refrigerant compressed in the compression chambers V1, V2 is bypassed to the discharge space 212, to suppress of the refrigerant in the respective compression chambers V1, V2 from being overcompressed.

The bypass hole can include a first bypass hole communicating with the first compression chamber V1 and a second bypass hole communicating with the second compression chamber V2.

Furthermore, a first back pressure hole 241*c* is disposed in the non-orbiting end plate portion 241, wherein the first back pressure hole 241*c* communicates with the compression chamber V having an intermediate pressure between a suction pressure and a discharge pressure. The first back pressure hole 241*c* is disposed to communicate with the second back pressure hole 262*a*, wherein the second back pressure hole 262*a* is provided in a support plate portion of a back pressure chamber assembly 260 to be described later. It will be understood that the first back pressure hole 241*c* is a back pressure hole disposed on a side of the non-orbiting scroll 240, and the second back pressure hole is a back pressure hole disposed on a side of the back pressure chamber assembly 260.

In addition, a plurality of guide protruding portions 244 are disposed on an outer circumferential surface of the non-orbiting end plate portion 241 along a circumferential direction, and the aforementioned guide holes 244*a* are disposed in the plurality of guide protruding portions 244, respectively.

The back pressure chamber assembly 260 according to the present implementation is provided above the non-orbiting scroll 240. Accordingly, the non-orbiting scroll 240 is pressed in a direction toward the orbiting scroll 250 by a back pressure force of the back pressure space S to seal the compression chamber V A back pressure of the back pressure space S can be understood as a force applied in the back pressure chamber as refrigerant and gas are discharged.

The back pressure chamber assembly 260 includes a back pressure plate 261 coupled to an upper surface of the non-orbiting scroll 240, and a floating plate portion 265 slidably coupled to the back pressure plate 261 to form a back pressure space S together with the back pressure plate 261. For example, as shown in FIG. 1, the floating plate portion 265 can be inserted into and provided above the back pressure plate 261.

For example, the back pressure plate 261 can be fastened by a plurality of bolts (no reference numeral) along a circumferential direction on an upper surface of the non-orbiting scroll 240. In this case, the plurality of bolts (no reference numeral) pass through the back pressure plate 261 inside the back pressure space S to be fastened to the non-orbiting end plate portion 241.

The back pressure plate 261 includes a support plate portion 262 brought into contact with the non-orbiting end plate portion 241. The support plate portion 262 is defined in a shape of an annular plate with a hollow center, and a second back pressure hole 262*a* communicating with the first back pressure hole 241*c* described above is disposed to pass therethrough in an axial direction. As illustrated in FIG. 4, the second back pressure hole 262*a* communicates with the back pressure space S. Accordingly, the compression chamber V and the back pressure space S can communicate with each other through the second back pressure hole 262*a* together with the first back pressure hole 241*c*.

A first annular wall 263 and a second annular wall 264 are disposed on an upper surface of the support plate portion 262 so as to surround an inner circumferential surface and an outer circumferential surface of the support plate portion 262. An outer circumferential surface of the first annular wall 263, an inner circumferential surface of the second annular wall 264, the upper surface of the support plate portion 262, and a lower surface of the floating plate portion 265 form a back pressure space S in an annular shape.

The first annular wall 263 is provided with an intermediate discharge port 263*a* communicating with the discharge port 241*a* of the non-orbiting scroll 240, and a valve guide groove 263*b* in which a check valve (hereinafter, discharge valve) 273 is slidably inserted is disposed in the intermediate discharge port 263*a*. Accordingly the check valve 273 is selectively opened and closed between the discharge port 241*a* and the intermediate discharge port 263*a* to suppress a discharged refrigerant from flowing back into the compression chamber V.

In the scroll compressor of the present disclosure, a central portion of the compression unit is designed to be thick in order to apply an adaptive back pressure structure to an end plate, rather than machining an adaptive back pressure hole in a wrap to allow the back pressure hole to be always covered, and when pressure is insufficient, a gap is opened between a fixed scroll and an orbiting scroll wrap to increase the pressure in the back pressure chamber while high-pressure gas flows into the back pressure chamber, and by that effect, the back pressure hole is closed again to maintain the pressure in the back pressure chamber.

In the scroll compressor of the present disclosure, even when back pressure ratio is not fixed and operating conditions are changed, back pressure can be adjusted according to an operating region of the compressor, that is, the operating conditions, thereby increasing the efficiency of the compressor.

In this manner, in the scroll compressor of the present disclosure, the efficiency of the compressor can be increased while the back pressure is automatically or adaptively adjusted in all operating regions.

In the scroll compressor of the present disclosure, due to a structure in which the back pressure hole is disposed in the orbiting end plate other than the orbiting wrap, it is convenient for application due to reduced design constraints, and machining cost and the number of additional parts is reduced due to the simplification of the back pressure structure.

Furthermore, in the scroll compressor of the present disclosure, a thickness of the central portion becomes larger by a structure that always covers the back pressure hole, thereby increasing the reliability of the compression unit, and solving the problem of rigidity of the wrap that occurs while machining the wrap.

In addition, in the scroll compressor of the present disclosure, a structure in which the back pressure hole communicates with the first back pressure chamber can be provided in the case of a high-pressure type, and a structure in which the back pressure hole communicates with the second back pressure chamber can be provided in the case of a low-pressure type, thereby allowing an adaptive back pressure structure regardless of the high-pressure or low-pressure type.

In some examples, in the scroll compressor of the present disclosure, a hole at an upper end of the fixed scroll wrap is close to the first back pressure chamber, but communicates with a hole outside the fixed scroll that is open at a position that is always blocked while the orbiting scroll rotates, and when the orbiting scroll retreats in an axial direction due to a low pressure in the first back pressure chamber during the driving of the compressor, a gap is generated between an upper end of the wrap of the fixed scroll and a bottom portion of the orbiting scroll to increase pressure in the back pressure chamber while high-pressure gas flows into the first back pressure chamber so as to maintain the sealing of the compression chamber while moving the orbiting scroll in the axial direction, thereby increasing the efficiency of the scroll compressor.

In this manner, in some implementations, an adaptive back pressure structure can be applied to minimize asymmetry while machining a back pressure hole in the discharge portion regardless of the chamber in which compression is in progress so as to increase the stability of the compressor, and to maintaining an appropriate back pressure while adapting to appropriate numerical values of back pressure and gas force in the back pressure chamber, thereby increasing the efficiency of the compressor.

In the scroll compressor of the present disclosure, the orbiting scroll can actively move in an axial direction by a relationship of forces between a back pressure chamber and a compression chamber regardless of operating conditions, thereby having constant performance in most operating regions.

More specifically, in the adaptive back pressure structure of the present disclosure, the orbiting back pressure hole can be always covered by the fixed wrap to allow the orbiting scroll to repeatedly advance and retreat in an axial direction due to a difference in force between the compression chamber and the back pressure chamber, thereby allowing pressure to flow into and block the back pressure chamber repeatedly through the back pressure hole through a gap between the wrap and the end plate.

In the scroll compressor of the present disclosure, a central portion of the compression unit is designed to be thick in order to apply an adaptive back pressure structure to an end plate, rather than machining an adaptive back pressure hole in a wrap to allow the back pressure hole to be always covered, and when pressure is insufficient, a gap is opened between a fixed scroll and an orbiting scroll wrap to increase the pressure in the back pressure chamber while high-pressure gas flows into the back pressure chamber, and by that effect, the back pressure hole is closed again to maintain the pressure in the back pressure chamber.

In the scroll compressor of the present disclosure, even when back pressure ratio is not fixed and operating conditions are changed, back pressure can be adjusted according to an operating region of the compressor, that is, the operating conditions, thereby increasing the efficiency of the compressor.

In this manner, in the scroll compressor of the present disclosure, the efficiency of the compressor can be increased while the back pressure is automatically or adaptively adjusted in all operating regions.

In the scroll compressor of the present disclosure, due to a structure in which the back pressure hole is disposed in the orbiting end plate other than the orbiting wrap, it is convenient for application due to reduced design constraints, and machining cost and the number of additional parts is reduced due to the simplification of the back pressure structure.

Furthermore, in the scroll compressor of the present disclosure, a thickness of the central portion becomes larger by a structure that always covers the back pressure hole, thereby increasing the reliability of the compression unit, and solving the problem of rigidity of the wrap that occurs while machining the wrap.

In addition, in the scroll compressor of the present disclosure, a structure in which the back pressure hole communicates with the first back pressure chamber can be provided in the case of a high-pressure type, and a structure in which the back pressure hole communicates with the second back pressure chamber can be provided in the case of a low-pressure type, thereby allowing an adaptive back pressure structure regardless of the high-pressure or low-pressure type.

In some examples, in the scroll compressor of the present disclosure, a hole at an upper end of the fixed scroll wrap is close to the first back pressure chamber, but communicates with a hole outside the fixed scroll that is open at a position that is always blocked while the orbiting scroll rotates, and when the orbiting scroll retreats in an axial direction due to a low pressure in the first back pressure chamber during the driving of the compressor, a gap is generated between an upper end of the wrap of the fixed scroll and a bottom portion of the orbiting scroll to increase pressure in the back pressure chamber while high-pressure gas flows into the first back pressure chamber so as to maintain the sealing of the compression chamber while moving the orbiting scroll in the axial direction, thereby increasing the efficiency of the scroll compressor.

In this manner, in some implementations, an adaptive back pressure structure can be applied to minimize asymmetry while machining a back pressure hole in the discharge portion regardless of the chamber in which compression is in progress so as to increase the stability of the compressor, and to maintaining an appropriate back pressure while adapting to appropriate numerical values of back pressure and gas force in the back pressure chamber, thereby increasing the efficiency of the compressor.

In the scroll compressor of the present disclosure, the orbiting scroll can actively move in an axial direction by a relationship of forces between a back pressure chamber and a compression chamber regardless of operating conditions, thereby having constant performance in most operating regions.

More specifically, in the adaptive back pressure structure of the present disclosure, the orbiting back pressure hole can be always covered by the fixed wrap to allow the orbiting scroll to repeatedly advance and retreat in an axial direction due to a difference in force between the compression chamber and the back pressure chamber, thereby allowing pressure to flow into and block the back pressure chamber repeatedly through the back pressure hole through a gap between the wrap and the end plate.

The aforementioned scroll compressor 100, 200 is not limited to the configuration and the method of the implementations described above, but the implementations can be configured such that all or some of the implementations are selectively combined so that various modifications can be made.

It is obvious to those skilled in the art that the present disclosure can be embodied in other specific forms without departing from the concept and essential characteristics thereof. The above detailed description is therefore to be construed in all aspects as illustrative and not restrictive. The scope of the disclosure should be determined by reasonable interpretation of the appended claims and all changes that come within the equivalent scope of the disclosure are included in the scope of the disclosure.

What is claimed is:

1. A scroll compressor comprising:

a casing;

a drive motor disposed inside the casing;

a rotating shaft rotatably coupled to the drive motor;

an orbiting scroll disposed inside the casing and coupled to the rotating shaft, the orbiting scroll comprising (i) an orbiting end plate portion coupled to the rotating shaft and (ii) an orbiting wrap that protrudes in a spiral shape from a surface of the orbiting end plate portion;

a fixed scroll comprising a fixed wrap engaged with the orbiting wrap, wherein the fixed wrap and the orbiting wrap are configured to define a compression chamber therebetween based on the orbiting wrap performing an orbital motion relative to the fixed wrap; and a main frame that rotatably supports the orbiting scroll, the main frame defining a first back pressure chamber with the orbiting scroll, wherein the orbiting scroll defines an orbiting back pressure hole having (i) a first end configured to fluidly communicate with the first back pressure chamber and (ii) a second end located between outer and inner circumferences of the fixed wrap, and wherein the fixed wrap is configured to cover at least a portion of the second end of the orbiting back pressure hole based on the orbiting wrap performing the orbital motion relative to the fixed wrap, wherein the orbiting end plate portion defines the orbiting back pressure hole at a position spaced apart from an inner circumference of the orbiting wrap in a radial direction, the orbiting back pressure hole extending from the inner circumference of the orbiting wrap in the radial direction through a portion of the orbiting wrap, wherein a thickness of a portion of the fixed wrap covering the orbiting back pressure hole is twice or more of an orbiting radius of the orbiting scroll.

2. The scroll compressor of claim 1, wherein the orbiting back pressure hole comprises:

a first hole that extends parallel to the rotating shaft; and a second hole that extends from an end of the first hole to the first back pressure chamber in a lateral direction, the second hole being in fluid communication with the first hole and the first back pressure chamber.

3. The scroll compressor of claim 1, wherein the orbiting back pressure hole extends through the orbiting end plate portion along a straight line from one end of the orbiting end plate portion to another end of the orbiting end plate portion.

4. The scroll compressor of claim 1, further comprising a refrigerant suction pipe coupled to the fixed scroll and configured to fluidly communicate with the compression chamber.

5. The scroll compressor of claim 1, wherein the fixed scroll further comprises a fixed end plate portion that defines a fixed back pressure hole, the fixed back pressure hole defining a passage that is bent at least once between the first end and the second end, and wherein the fixed wrap is disposed on the fixed end plate portion.

6. The scroll compressor of claim 5, wherein the orbiting wrap is configured to define a plurality of overlapping portions with the fixed wrap based on relative positions of the orbiting wrap with respect to the fixed wrap during the orbital motion, and wherein the fixed back pressure hole is defined at one of the plurality of overlapping portions of the fixed wrap.

7. The scroll compressor of claim 6, wherein the relative positions of the orbiting wrap are defined based on the orbiting wrap rotating with respect to the fixed wrap by 0 degrees at which the orbiting back pressure hole is covered by a portion of the fixed wrap, 90 degrees, 180 degrees, and 270 degrees, respectively.

8. The scroll compressor of claim 5, wherein the fixed back pressure hole comprises:

a first hole portion having one end at an end portion of the orbiting wrap, the first hole portion extending parallel to the rotating shaft;

a second hole portion that is in fluid communication with the first hole portion, the second hole portion intersecting the first hole portion and extending in a lateral direction; and a third hole portion that is in fluid communication with the second hole portion and the first back pressure chamber, the third hole portion extending parallel to the first hole portion.

9. The scroll compressor of claim 5, wherein the fixed scroll further defines a guide inlet portion between the fixed back pressure hole and the first back pressure chamber, the guide inlet portion being configured to guide inflow of gas from the fixed back pressure hole to the first back pressure chamber.

10. The scroll compressor of claim 1, wherein the fixed wrap further comprises a fixed step surface that defines one or more heights of the fixed wrap, and wherein the orbiting back pressure hole is configured to be covered by a portion of the fixed wrap that is connected to the fixed step surface.

11. The scroll compressor of claim 1, wherein the orbiting end plate portion comprises a boss portion that is coupled to the rotating shaft.

12. A scroll compressor comprising: a casing; a drive motor disposed inside the casing; a rotating shaft rotatably coupled to the drive motor; an orbiting scroll disposed inside the casing and coupled to the rotating shaft, the orbiting scroll comprising (i) an orbiting end plate portion coupled to the rotating shaft and (ii) an orbiting wrap that protrudes in a spiral shape from a surface of the orbiting end plate portion; a fixed scroll comprising a fixed wrap engaged with the orbiting wrap, wherein the fixed wrap and the orbiting wrap are configured to define a compression chamber therebetween based on the orbiting wrap performing an orbital motion relative to the fixed wrap; and a main frame that rotatably supports the orbiting scroll, the main frame defining a first back pressure chamber with the orbiting scroll, wherein the orbiting scroll defines an orbiting back pressure hole having (i) a first end configured to fluidly communicate with the first back pressure chamber and (ii) a second end located between outer and inner circumferences of the fixed wrap, and wherein the fixed wrap is configured to cover at least a portion of the second end of the orbiting back pressure hole based on the orbiting wrap performing the orbital motion relative to the fixed wrap, wherein the fixed scroll further comprises a fixed end plate portion that defines a fixed back pressure hole, the fixed back pressure hole defining a passage that is bent at least once between the first end and the second end, and wherein the fixed wrap is disposed on the fixed end plate portion, wherein the orbiting wrap has an end portion that is configured to cover the fixed back pressure hole based on the orbiting wrap performing the orbital motion relative to the fixed wrap, and wherein a thickness of the end portion of the orbiting wrap is twice or more of an orbiting radius of the orbiting scroll.

13. A scroll compressor comprising:

a casing;

a drive motor disposed inside the casing;

a rotating shaft rotatably coupled to the drive motor;

an orbiting scroll disposed inside the casing and coupled to the rotating shaft, the orbiting scroll comprising (i) an orbiting end plate portion coupled to the rotating shaft and (ii) an orbiting wrap having a spiral shape extending from one surface of the orbiting end plate portion; and a fixed scroll comprising (i) a fixed end plate portion and (ii) a fixed wrap disposed on the fixed end plate portion and engaged with the orbiting wrap, wherein the fixed wrap and the orbiting wrap are configured to define a compression chamber therebetween based on the orbiting wrap performing an orbital motion relative to the fixed wrap; and a main frame that rotatably supports the orbiting scroll, the main frame defining a first back pressure chamber with the orbiting scroll, wherein the orbiting end plate portion defines an orbiting back pressure hole comprising:

a first hole that extends parallel to the rotating shaft, and a second hole that extends in a lateral direction from one end of the first hole to the first back pressure chamber and fluidly communicates between the first hole and the first back pressure chamber, wherein the first hole is defined between outer and inner circumferences of the fixed wrap such that the fixed wrap covers at least a portion of the first hole during the orbital motion of the orbiting wrap relative to the fixed wrap, wherein the fixed end plate portion defines a fixed back pressure hole having (i) a first end that is in fluid communication with the first back pressure chamber and (ii) a second end that is covered by an end portion of the orbiting wrap, the fixed back pressure hole defining a passage that is bent at least once between the first end and the second end, and wherein a thickness of the end portion of the orbiting wrap is twice or more of an orbiting radius of the orbiting scroll.

14. The scroll compressor of claim 13, wherein a thickness of a portion of the fixed wrap covering the first hole is twice or more of the orbiting radius of the orbiting scroll.

15. The scroll compressor of claim 13, further comprising a refrigerant suction pipe coupled to the fixed scroll and configured to fluidly communicate with the compression chamber.

16. The scroll compressor of claim 13, wherein the orbiting wrap is configured to define a plurality of overlapping portions with the fixed wrap based on relative positions of the orbiting wrap with respect to the fixed wrap during the orbital motion, and wherein the fixed back pressure hole is defined at one of the plurality of overlapping portions.

17. The scroll compressor of claim 13, wherein the fixed back pressure hole comprises:

a first hole portion having the first end defined at the end portion of the orbiting wrap, the first hole portion extending parallel to the rotating shaft;

a second hole portion that is in fluid communication with the first hole portion, the second hole portion intersecting the first hole portion and extending in the lateral direction; and a third hole portion that is in fluid communication with the second hole portion and the first back pressure chamber, the third hole portion extending parallel to the first hole portion.

18. The scroll compressor of claim 13, wherein the fixed scroll further defines a guide inlet portion between the fixed back pressure hole and the first back pressure chamber, the guide inlet portion being configured to guide inflow of gas from the fixed back pressure hole to the first back pressure chamber.

* * * * *